US011121502B2

(12) United States Patent
Kasar et al.

(10) Patent No.: US 11,121,502 B2
(45) Date of Patent: Sep. 14, 2021

(54) MAGNETIC CONNECTORS

(71) Applicant: Apple Inc., Cupertino, CA (US)

(72) Inventors: Darshan R. Kasar, San Francisco, CA (US); Brian C. Joseph, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/810,755

(22) Filed: Mar. 5, 2020

(65) Prior Publication Data

US 2020/0328558 A1 Oct. 15, 2020

Related U.S. Application Data

(63) Continuation-in-part of application No. 15/713,700, filed on Sep. 25, 2017, now abandoned.
(Continued)

(51) Int. Cl.
*H01R 13/625* (2006.01)
*H01R 13/62* (2006.01)
(Continued)

(52) U.S. Cl.
CPC ..... *H01R 13/6205* (2013.01); *H01R 13/20* (2013.01); *H01R 13/508* (2013.01);
(Continued)

(58) Field of Classification Search
CPC .. H01R 13/6205; H01R 13/20; H01R 13/508; H01R 13/582; H01R 13/6584
(Continued)

(56) References Cited

U.S. PATENT DOCUMENTS 2,046,221 A * 6/1936 Thomas ..... H01R 13/625 337/187
3,047,828 A * 7/1962 Gregson ..... H01R 24/40 439/248

(Continued)

FOREIGN PATENT DOCUMENTS

| | | |
|---|---|---|
| CN | 200997477 | 12/2007 |
| CN | 104112960 | 10/2014 |
| WO | 2014026383 | 2/2014 |

OTHER PUBLICATIONS

Coming Gilbert GPPO Connectors, Hasco, Inc. Components Distributer, Sep. 29, 2017, 6 pages.

(Continued)

*Primary Examiner* — Alexander Gilman
(74) *Attorney, Agent, or Firm* — Kilpatrick Townsend & Stockton

(57) ABSTRACT

Magnetic connector systems including a plug connector and a connector receptacle. In one example, the plug connector can include a magnetic target around a signal pin, where the signal pin is insulated from a plug enclosure by an insulating housing. The connector receptacle can include a magnet that is attracted to the magnetic target. The connector receptacle can contact the plug enclosure using one or more conductive springs. The one or more springs can deflect during an insertion of the plug enclosure. In another example, this deflection can act to expel moisture from the connector receptacle through drip holes in an enclosure for the connector receptacle.

20 Claims, 31 Drawing Sheets

Related U.S. Application Data

(60) Provisional application No. 62/399,303, filed on Sep. 23, 2016.

(51) Int. Cl.
*H01R 13/20* (2006.01)
*H01R 13/58* (2006.01)
*H01R 13/508* (2006.01)
*H01R 13/66* (2006.01)
*H01R 13/6584* (2011.01)

(52) U.S. Cl.
CPC ..... *H01R 13/582* (2013.01); *H01R 13/6584* (2013.01); *H01R 13/6658* (2013.01)

(58) Field of Classification Search
USPC ..... 439/38
See application file for complete search history.

(56) References Cited

U.S. PATENT DOCUMENTS 3,480,722 A * 11/1969 Horssen ..... 174/87
3,760,332 A * 9/1973 Berkovits ..... H01R 13/5224 439/381
3,808,577 A * 4/1974 Mathauser ..... H01R 13/6205 439/39
3,810,258 A * 5/1974 Mathauser ..... H01R 13/6205 439/39
4,148,538 A * 4/1979 Rodondi ..... H01R 13/6278 439/347
4,261,630 A * 4/1981 Knappenberger ..... H01R 24/52 333/260
4,690,495 A * 9/1987 Giannini ..... G02B 6/32 385/57
4,704,347 A * 11/1987 Vollenbroek ..... G03F 7/095 430/156
5,246,378 A * 9/1993 Seiceanu ..... H01R 13/7032 200/51.03
5,316,499 A * 5/1994 Scannelli ..... H01R 24/52 439/534
5,385,476 A * 1/1995 Jasper ..... H01R 13/6633 439/38
5,401,175 A * 3/1995 Guimond ..... H01R 13/6205 439/38
5,738,546 A * 4/1998 Burroughs ..... H01R 24/44 333/25
5,938,465 A * 8/1999 Fox, Sr. ..... H01R 13/627 439/350
5,938,645 A 8/1999 Gordon
6,010,346 A * 1/2000 Wang ..... F21V 21/002 439/206
6,027,373 A * 2/2000 Gray ..... H01R 4/489 174/74 R
6,210,221 B1 * 4/2001 Maury ..... H01R 9/0521 439/578
6,319,039 B1 * 11/2001 Chambly ..... H01R 13/5219 439/282
6,407,708 B1 * 6/2002 Jasper, Jr. ..... H01Q 15/08 343/701
6,648,684 B2 * 11/2003 Tang ..... H01R 9/0524 439/387
6,688,916 B1 * 2/2004 Lee ..... H01R 13/6666 361/119
6,860,761 B2 * 3/2005 Lee ..... H01R 4/28 439/582
7,264,479 B1 * 9/2007 Lee ..... H01R 11/30 439/39
7,347,727 B2 * 3/2008 Wlos ..... H01R 13/6277 439/578
7,387,531 B2 * 6/2008 Cook ..... G01R 31/58 439/578
7,621,753 B1 * 11/2009 Pai ..... H01R 13/6205 439/39
7,641,476 B2 * 1/2010 Didur ..... H01R 13/6205 439/39
7,758,370 B1 * 7/2010 Flaherty ..... H01R 24/50 439/352
7,789,667 B2 * 9/2010 Zhu ..... H01R 24/40 439/39
7,887,365 B1 * 2/2011 Omer ..... H01R 13/6277 439/585
7,946,886 B1 * 5/2011 Liu ..... H01R 4/36 439/582
8,162,672 B2 * 4/2012 Huang ..... H01R 13/11 439/63
8,366,483 B2 * 2/2013 Hardy ..... H01R 24/40 439/585
8,500,455 B2 * 8/2013 Jin ..... H01R 13/6205 439/63
8,602,795 B2 * 12/2013 Hsu ..... H01R 13/6205 439/39
8,613,631 B2 * 12/2013 Hemmi ..... H01R 12/88 439/495
8,636,542 B2 * 1/2014 Funahashi ..... H01R 24/545 439/582
8,647,132 B2 * 2/2014 Kuroda ..... H01R 13/5227 439/271
8,690,582 B2 * 4/2014 Rohrbach ..... G06F 1/1633 439/39
8,702,594 B2 * 4/2014 Edidin ..... H01R 43/26 600/136
8,721,365 B2 * 5/2014 Holland ..... H01R 9/0524 439/584
8,790,136 B2 * 7/2014 Duesterhoeft ..... H01R 13/6596 439/607.35
8,827,731 B2 * 9/2014 Sasaki ..... B60L 53/18 439/206
8,827,743 B1 * 9/2014 Maury ..... H01R 13/622 439/578
9,080,734 B2 * 7/2015 Andersen ..... F21L 4/00
9,099,797 B1 * 8/2015 Duesterhoeft ..... H01R 24/545
9,099,825 B2 * 8/2015 Wild ..... H01R 24/566
9,281,637 B2 * 3/2016 Holliday ..... H01R 24/38
9,577,355 B1 * 2/2017 Shaw ..... H01R 43/26
9,678,127 B2 * 6/2017 Even ..... G01R 29/0878
9,698,524 B1 * 7/2017 Morgan ..... H01R 11/30
9,711,893 B2 * 7/2017 Rohrbach ..... G06F 1/18
9,716,345 B2 * 7/2017 Watkins ..... H01R 13/6584
9,735,520 B2 * 8/2017 Davidson, Jr. ..... H01R 43/26
9,893,485 B2 * 2/2018 Chhuor ..... H01R 13/6205
10,014,631 B1 * 7/2018 Chambly ..... H01R 13/5219
10,243,296 B2 * 3/2019 Cheng ..... H01R 13/18
10,297,961 B2 * 5/2019 Takahashi ..... H01R 13/504
10,383,367 B2 * 8/2019 Rasmussen ..... A61M 11/042
10,535,962 B2 * 1/2020 So ..... H01R 24/42
10,622,749 B2 * 4/2020 Watkins ..... H01R 13/622
10,797,412 B2 * 10/2020 Barthelmes ..... H01R 9/0521
10,819,047 B2 * 10/2020 Watkins ..... H01R 13/035
2003/0045134 A1 * 3/2003 Downing ..... H01R 13/6205 439/38
2005/0042920 A1 * 2/2005 Poiraud ..... H01R 4/5033 439/582
2012/0021618 A1 * 1/2012 Schultz ..... H01R 43/20 439/38
2013/0065406 A1 3/2013 Rohrbach et al.
2014/0017937 A1 1/2014 Holliday et al.
2014/0315395 A1 * 10/2014 Liu ..... H01R 13/6205 439/34

OTHER PUBLICATIONS

Department of Defense Interface Standard (MIL-STD-3488), MIL-STD-3488, Available on internet at http://www.everyspec.com, Aug. 17, 2014, 222 pages.
SSMP Interconnect Series, Carlisle Interconnect Technologies, 2012, 5 pages.
U.S. Appl. No. 15/713,700, Final Office Action dated Nov. 28, 2018, 12 pages.

(56) References Cited

OTHER PUBLICATIONS

U.S. Appl. No. 15/713,700, Final Office Action dated Nov. 5, 2019, 13 pages.
U.S. Appl. No. 15/713,700, First Action Interview Office Action Summary dated Aug. 6, 2018, 14 pages.
U.S. Appl. No. 15/713,700, First Action Interview Pilot Program Pre-Interview Communication dated Apr. 19, 2018, 5 pages.
U.S. Appl. No. 15/713,700, Non-Final Office Action dated Jun. 4, 2019, 10 pages.
European Application No. 17192703.1, Extended European Search Report dastedn Nov. 2, 2017, 9 pages.
European Application No. 17192703.1, Office Action dated Dec. 5, 2018, 8 pages.

* cited by examiner

MAGNETIC CONNECTORS

TECHNICAL FIELD

This disclosure relates generally to connector systems and more particularly to magnetic connectors.

BACKGROUND

Power and data can be provided from one electronic device to another over cables that can include one or more wires, fiber optic cables, or other conductors. Connector inserts can be located at each end of these cables and can be inserted into connector receptacles in the communicating or power transferring electronic devices.

In some systems, these cables can convey very high-speed signals. To achieve these high speeds, they can include various interlocking features to keep a connector insert and a connector receptacle mated in a secure and consistent manner. But these features can make the connectors difficult to use. Accordingly, it can be desirable to provide connector inserts and connector receptacles that do not rely on these interlocking features to provide a secure and consistent connection.

Moreover, these connector receptacles can be located on an electronic device such that they can be accessible only in spaces with limited dimensions. For example, these connector receptacles can be located in openings in equipment, they can be positioned relatively close to each other, they can be close to other structures on a device, or access can be dimensionally limited for some other reason.

To be able to convey very high-frequency signals, it can be important to provide a good impedance matching along a signal path. That is, it can be desirable to avoid impedance changes, stubs, and the like along the signal path. Doing so can reduce return loss, thereby improving signal quality. Conversely, errors or mismatches in impedances along a high-frequency signal path can generate reflections and insertion loss. These can degrade and corrupt a signal making reliable data transmission difficult or impossible.

Users have become accustomed to connecting devices together using cables. Plugging a phone into a charger is now a common experience. Some of these connectors provide an excellent user experience. As a result, it can be very disconcerting for a user to have a connector that is difficult to use. For this reason, it can be important to provide a connector system that provides a good user experience.

Thus, what is needed are connector systems that can be easy to use, can be used to make connections in a small area, can provide a stable and consistent connection, can provide good impedance matching, and can provide a good user experience.

SUMMARY

Accordingly, embodiments of the present invention can provide connector systems that can be easy to use, can be used to make connections in a small area, can provide a stable and consistent connection, can provide good impedance matching, and can provide a good user experience. Various embodiments of the present invention can provide connector systems for conveying high-speed signals.

An illustrative embodiment of the present invention can provide a connector system including a connector insert and a connector receptacle. The connector insert can include a center conductor having a central recess at a front leading edge and an outer barrel. An outer barrel can terminate in a tulip-shaped connector around the recessed portion of the center conductor. A housing can be formed around the barrel behind the tulip-shaped contact. The housing can include one or more magnets on at least one side of the barrel. In these and other embodiments of the present invention, the one or more magnets can be on at least two sides of the barrel. The two sides can be opposite sides. In these and other embodiments of the present invention, the one or more magnets can be positioned concentrically around the barrel. For example, one or more magnets can be positioned concentrically around the barrel. The one or more magnets can have a protective layer on one or more sides. Instead of magnets, one or more ferromagnetic portions can be used in these and other configurations, or a combination of magnets and ferromagnetic pieces can be used. The center conductor and the outer barrel can terminate in conductors in a cable. The cable can be insulated. The cable can be protected with a strain relief.

The connector receptacle can include a housing supporting a ground contact. The magnet or magnets of the connector insert can be attracted to the ground contact. The ground contact can have a passage for a pin having a concentric insulating layer. The passage in the ground contact can also accept the tulip of the connector insert to provide a ground path. The pin can be inserted in the recess of the center conductor. This penetrating connection can stand in contrast to other connectors where a surface connection can be made. The pin can terminate on a board in an electronic device. The ground contact can also terminate on the board.

This connector system can be easy to use. Specifically, the magnet in the connector insert can be attracted to the ground contact in the connector receptacle. The pin of the connector receptacle can penetrate the center conductor of the connector insert without the need of turning or tightening. The magnet or magnets can fix a position to the ground contact of the connector receptacle in a consistent and stable manner. The penetration of the pin into the center conductor of the connector insert can provide a signal path having good impedance matching. The magnetic attraction of the connector insert to the connector receptacle can provide a good user experience.

In these and other embodiments of the present invention, the ground contact can be made of ferromagnetic material that can attract magnets, it can be formed of one or more magnets, or it can be a combination of these. In these and other embodiments of the present invention, the magnet or magnets of the connector insert can instead be ferromagnetic material that can be attractive to magnets in the connector receptacle, or magnets can be located in both the connector insert and the connector receptacle. In these and other embodiments of the present invention, each of the connector insert and connector receptacle can include one more magnets, one or more ferromagnetic pieces, or a combination of these.

Another illustrative embodiment of the present invention can provide a connector system including a plug connector and a connector receptacle. The plug connector can include an enclosure including a front plug enclosure and an enclosure back body. The plug enclosure can include a notch. This notch can retain a gasket or O-ring. A signal pin can include a pin tip and a connecting portion. The signal pin can be insulated from the plug enclosure and enclosure back body by insulating housings. A gasket or O-ring can be placed in a recess of one of the insulating housings to form a seal between the insulating housings to reduce moisture ingress into the plug connector.

The connector receptacle can be housed in an enclosure and a back enclosure. A front portion of the back enclosure can fit in a rear of the enclosure. The enclosure and back enclosure can surround and shield a tulip pin. The tulip pin can include a connecting portion, which can accept a conductor in a cable. The tulip pin can be isolated from the enclosure and the back enclosure by insulating housings. A gasket or O-ring can fit in a recess in one of the insulating housings to seal the insulating housings to each other to reduce moisture ingress into the connector receptacle. A cable crimp can accept a conductor and a braiding or other shielding of cable. Solder can be applied in an opening in the cable crimp to solder the braiding of cable to the cable crimp. Another gasket or O-ring can fit around a front portion of an insulating housing to form a seal with a front portion of the back enclosure. A perimeter spring and face spring can contact a plug enclosure of a corresponding plug connector when the plug connector is inserted into the connector receptacle. A front opening in the enclosure can provide access to the perimeter spring, the face spring, and the contact portion of the tulip pin.

The perimeter spring can include a front band and a back band. Cross-members or deflecting members can extend from the front band to the back band and can be separated by slots or openings. A break can be placed in either or both the front band and the back band to allow expansion and contraction of the perimeter spring as a plug connector is inserted and removed from the connector receptacle. The face spring can include teeth extending from a ring. The teeth can be clocked or angled relative to an inside surface of the ring. The teeth can be angled away from a plane defined by the ring in a direction towards the perimeter spring. The teeth can have an increased spacing along an inside surface of the ring. This increased spacing can help to reduce the buildup of debris and particulates that could otherwise foul the face spring.

When the plug connector is inserted into the connector receptacle, a plug enclosure can deflect the cross-members of the perimeter spring, thereby deforming the cross-members towards an inside surface of enclosure. This deflection or deformation can help to expel fluids or other debris that can be located in the front opening of the connector receptacle out drip holes in the enclosure. Remaining moisture and debris can be pushed into a well between an insulating housing and a front portion of the back enclosure. A gasket or O-ring can help to prevent moisture in the well from being pushed further back into the connector receptacle.

Multiple features can help to retain a plug connector in a connector receptacle when the plug connector is inserted into the connector receptacle. For example, cross-members of the perimeter spring in the connector receptacle can exert a holding force on a plug enclosure of the plug connector. Also, a contact portion of the tulip pin in the connector receptacle can hold a pin tip of a signal pin in the plug connector. The contact portion can have a reduced number of beams, such as three, four, or more than four beams. These beams can also be arranged to have a longer length and increased thickness to provide an increase in their durability and retention force.

In various embodiments of the present invention, pins, ground contacts, and other conductive portions of a connector receptacle or connector insert can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the housings, insulators, or other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The boards used can be formed of FR-4 or other material. The boards can be printed circuit boards or other substrates, such as flexible circuit boards, in many embodiments of the present invention. The magnets can be rare-earth or other types of magnets.

Embodiments of the present invention can provide connector receptacles and connector inserts that can be located in, and can connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, test systems, adapters, remote control devices, chargers, and other devices. In various embodiments of the present invention, interconnect paths provided by these connector inserts and connector receptacles can be used to convey power, ground, high-speed or other data signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
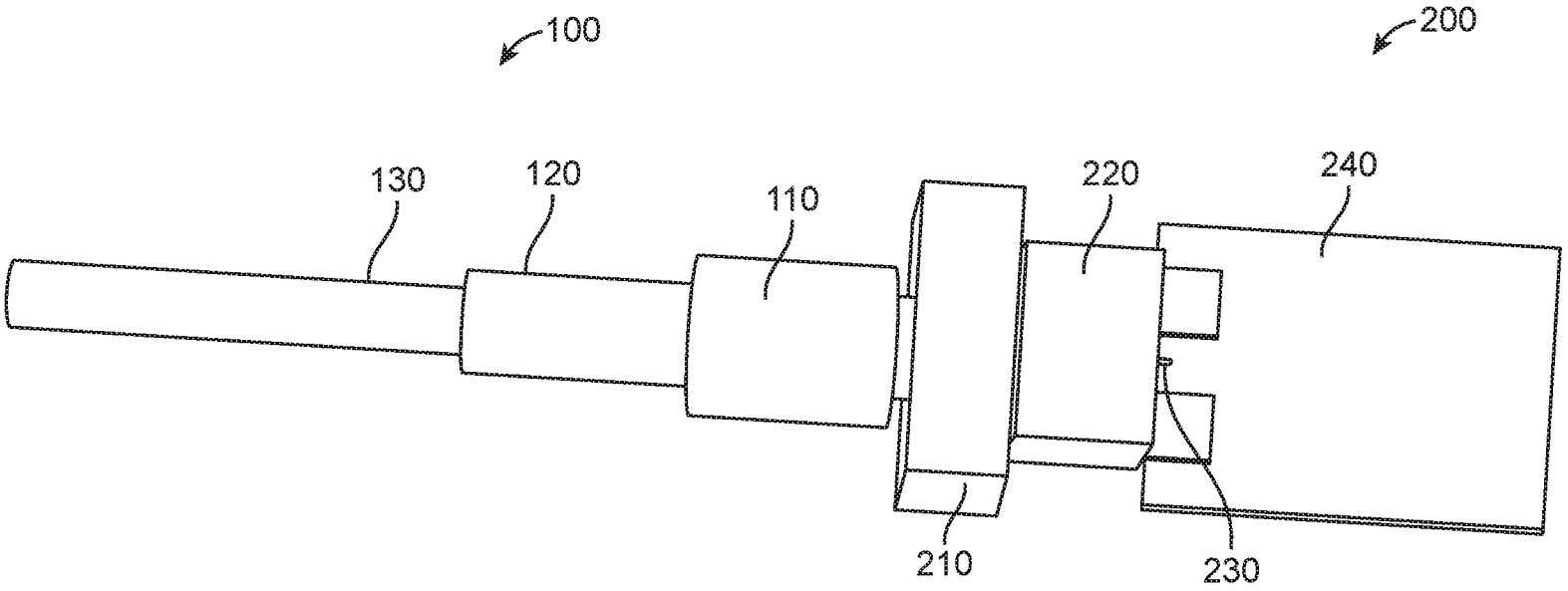
FIG. 1 illustrates a connector system according to an embodiment of the present invention.

FIG. 1 illustrates a connector system according to an embodiment of the present invention. This illustrative embodiment of the present invention can provide a connector system including connector insert 100 and connector receptacle 200. This figure, as with the other included figures is shown for illustrative purposes and does not limit either the possible embodiments of the invention or the claims.

Connector insert 100 can include housing 110 and cable 130. Cable 130 can be protected by strain relief 120. Connector receptacle 200 can include housing 210, connector 220, pin 230, and board 240. More details of this connector system are shown in the following figure.

Figure 2:
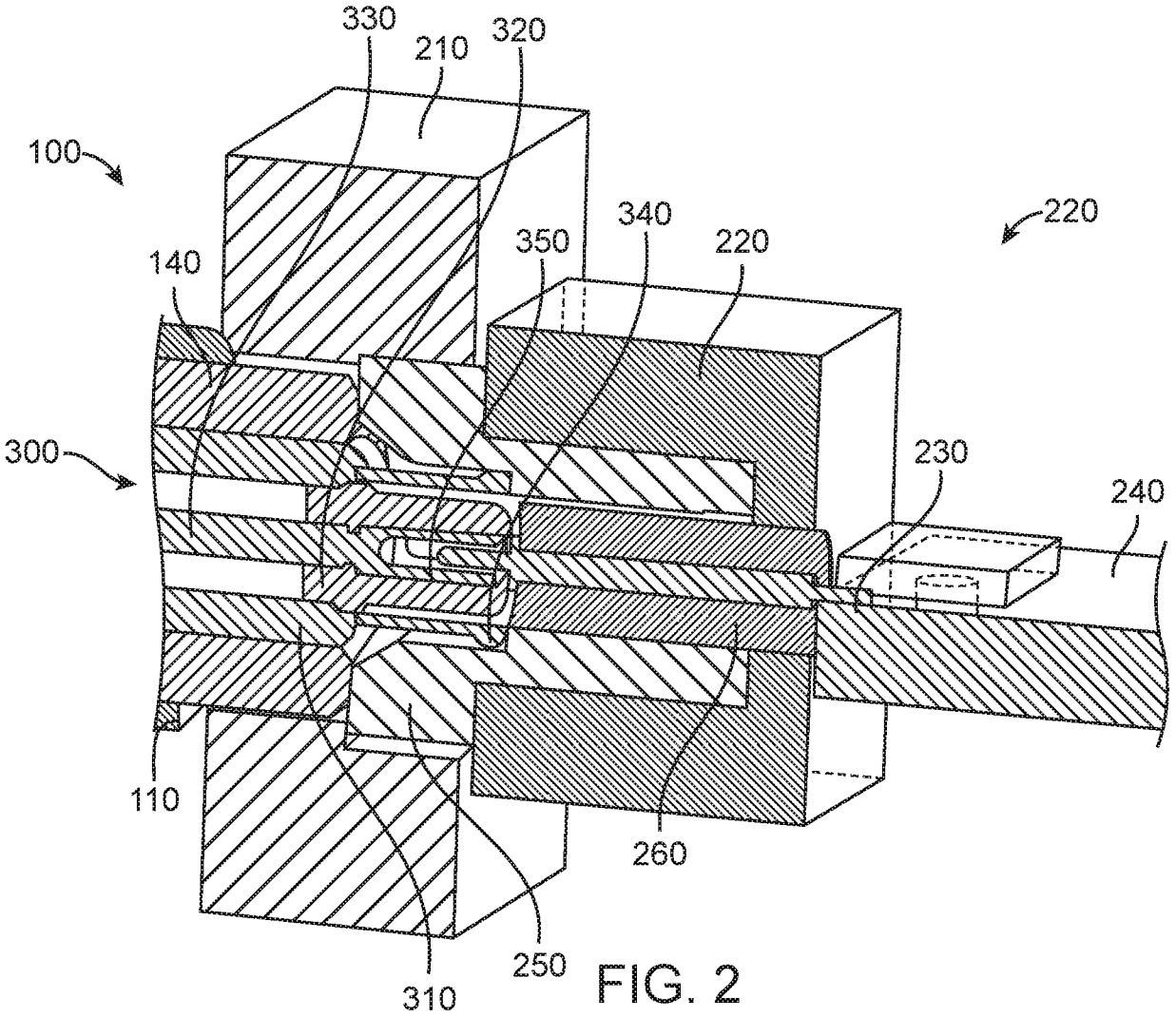
FIG. 2 illustrates a cross-section of a connector system according to an embodiment of the present invention.

FIG. 2 illustrates a cross-section of a connector system according to an embodiment of the present invention. Connector insert 100 can include a connector portion 300 having a center conductor 330 having a recess 350. The connector portion 300 can further include an outer barrel 310. Outer barrel 310 can be positioned concentrically around center conductor 330. Outer barrel 310 can terminate in contact 340 around recess 350 of center conductor 330. Housing 110 can be formed around connector portion 300. Housing 110 can include one or more magnets 140 on at least one side of connector portion 300. In these and other embodiments of the present invention, one or more magnets 140 can be on at least two sides of connector portion 300. The two sides can be opposite sides. In these and other embodiments of the present invention, one or more magnets 140 can be positioned concentrically around connector portion 300. For example, one magnet 140 can be positioned concentrically around connector portion 300. Magnets 140 can have a protective layer on one or more sides. In these and other embodiments of the present invention, one or more magnets 140 can instead be ferromagnetic pieces that can be attracted to one or more magnets in the connector receptacle. Center conductor 330 of connector portion 300 can terminate in conductors in cable 130 (shown in FIG. 1.) Cable 130 can be insulated. Cable 130 can be protected with strain relief 120 (shown in FIG. 1.)

Connector receptacle 200 can include housing 210, which can provide a passage for a leading edge of connector insert 100. Connector receptacle 200 can include connector 220 supporting ground contact 250. The magnet or magnets 140 of connector insert 100 can be attracted to ground contact 250, which can be made of a ferromagnetic material. In these and other embodiments of the present invention, the magnet or magnets 140 of connector insert 100 can instead be ferromagnetic pieces and ground contact 250 can be, or can include, one or more magnets. Ground contact 250 can have a passage for pin 230, which can be soldered to board 240. The passage can include a concentric insulating layer or insulator 260 around a portion of pin 230. The passage in ground contact 250 can also accept contact 340 of connector insert 100 to provide a ground path. Pin 230 can be inserted in recess 350 of center conductor 330 of connector portion 300 when connector insert 100 and connector receptacle 200 are mated. This penetrating connection can stand in contrast to other connectors where a surface connection can be made. The pin 230 can terminate on a board 240 in an electronic device. Ground contact 250 can also terminate on board 240.

The combination of the penetrating connection between pin 230 and recess 350 of center conductor 330, along with the magnetic attraction between connector insert 100 and connector receptacle 200 can provide a stable and consistent connection with little reflection and good impedance characteristics. More specifically, magnet 140 in connector insert 100 can be attracted to ground contact 250 in connector receptacle 200. Pin 230 of connector receptacle 200 can penetrate center conductor 330 of connector portion 300 in connector insert 100 without the need of turning or tightening. Magnet or magnets 140 can fix a position to ground contact 250 of connector receptacle 200 in a consistent and stable manner. The penetration of pin 230 into recess 350 in center conductor 330 of connector portion 300 can provide a signal path having good impedance matching. The magnetic attraction of connector insert 100 to connector receptacle 200 can provide a good user experience.

In these and other embodiments of the present invention, ground contact 250 can be formed of a ferromagnetic material that can attract magnets 140, it can be formed of one or more magnets, or it can be a combination of these. In these and other embodiments of the present invention, the magnet or magnets 140 of connector insert 100 can instead be ferromagnetic pieces that are attractive to magnets in connector receptacle 200, or magnets 140 can be located in both connector insert 100 and connector receptacle 200.

Figure 3:
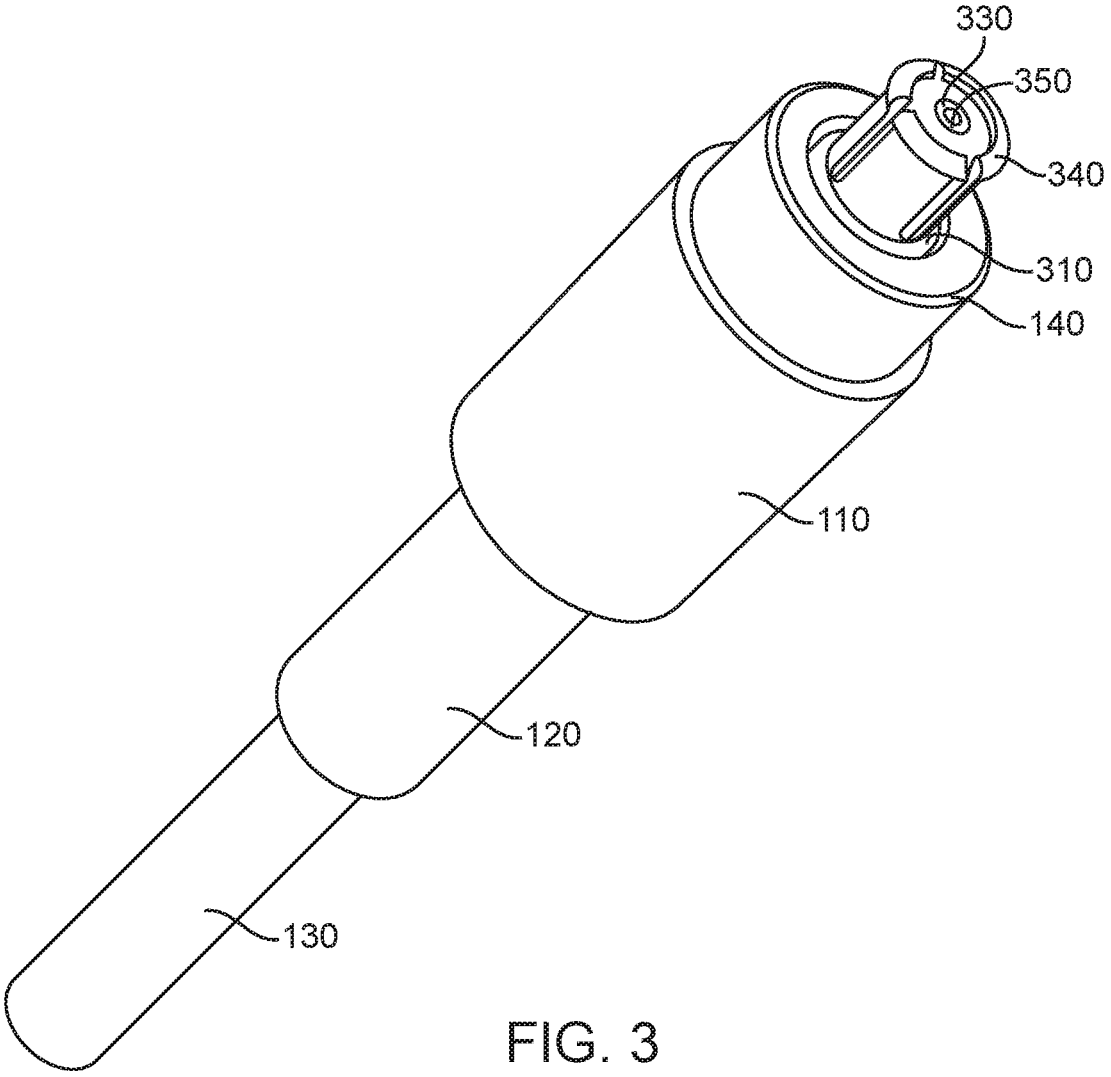
FIG. 3 illustrates a connector insert according to an embodiment of the present invention.

FIG. 3 illustrates a connector insert according to an embodiment of the present invention. Center conductor 330 can include central recess 350 and can be surrounded by contact 340 of outer barrel 310 of connector portion 300 (shown in FIG. 2.) Housing 110 can be around magnet 140. Magnet 140 can be protected with a coating or other layer. Connector insert 100 and connector receptacle 200 can be arranged to provide a protective spacing between them for magnet 140. Cable 130 can be protected by strain relief 120.

Figure 4:
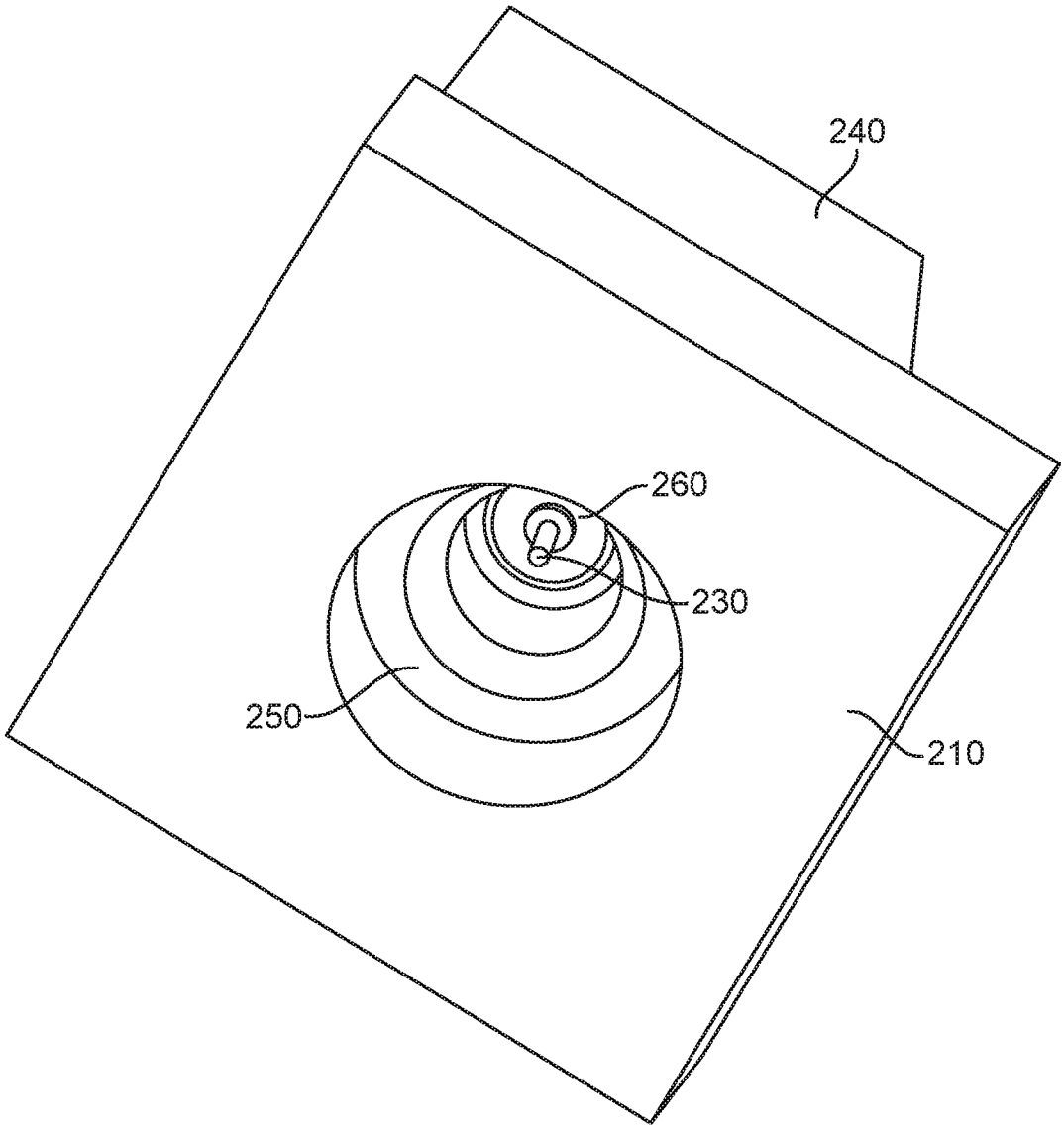
FIG. 4 illustrates a connector receptacle according to an embodiment of the present invention.

FIG. 4 illustrates a connector receptacle according to an embodiment of the present invention. Housing 210 can provide access to ground contact 250. Ground contact 250 can have an opening for pin 230 and insulator 26. Pin 230 can attached to board 240.

Figure 5:
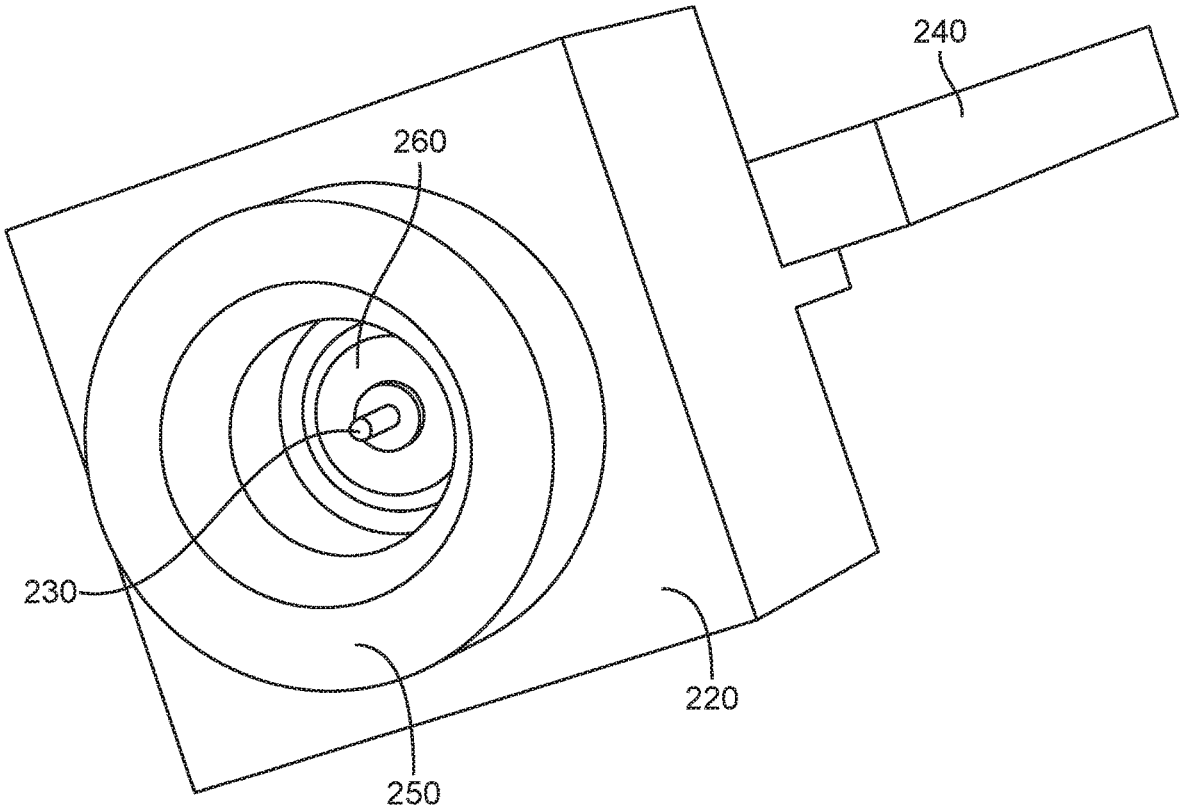
FIG. 5 illustrates a portion of a connector receptacle according to an embodiment of the present invention.

FIG. 5 illustrates a portion of a connector receptacle according to an embodiment of the present invention. In this example housing 210 has been removed to show connector 220, ground contact 250, pin 230, and insulator 260. Pin 230 can attached to board 240.

Figure 6:
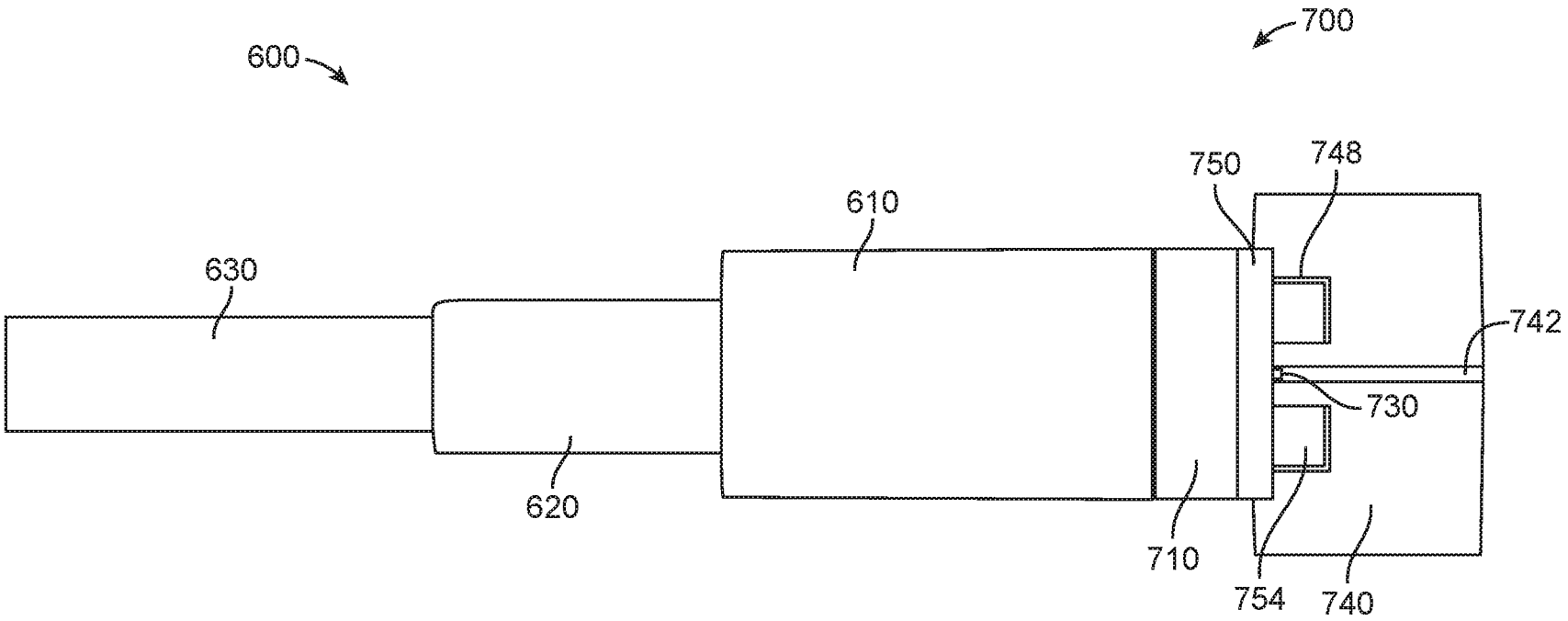
FIG. 6 illustrates another connector system according to an embodiment of the present invention.

FIG. 6 illustrates a connector system according to an embodiment of the present invention. This illustrative embodiment of the present invention can provide a connector system including connector insert 600 and connector receptacle 700. Connector insert 600 and connector receptacle 700 can be substantially similar to connector insert 100 and connector receptacle 200 in the above examples, with various modifications, some of which are described below.

Connector insert 600 can include housing 610 and cable 630. Cable 630 can be protected by strain relief 620. Connector receptacle 700 can include magnetic target 710, pin 730, board 740, and ground contact 750. Pin 730 can connect to trace 742 on board 740. Ground contact 750 can include tabs 754, which can electrically connect to ground traces or planes 748 on board 740. More details of this connector system are shown in the following figure.

Figure 7:
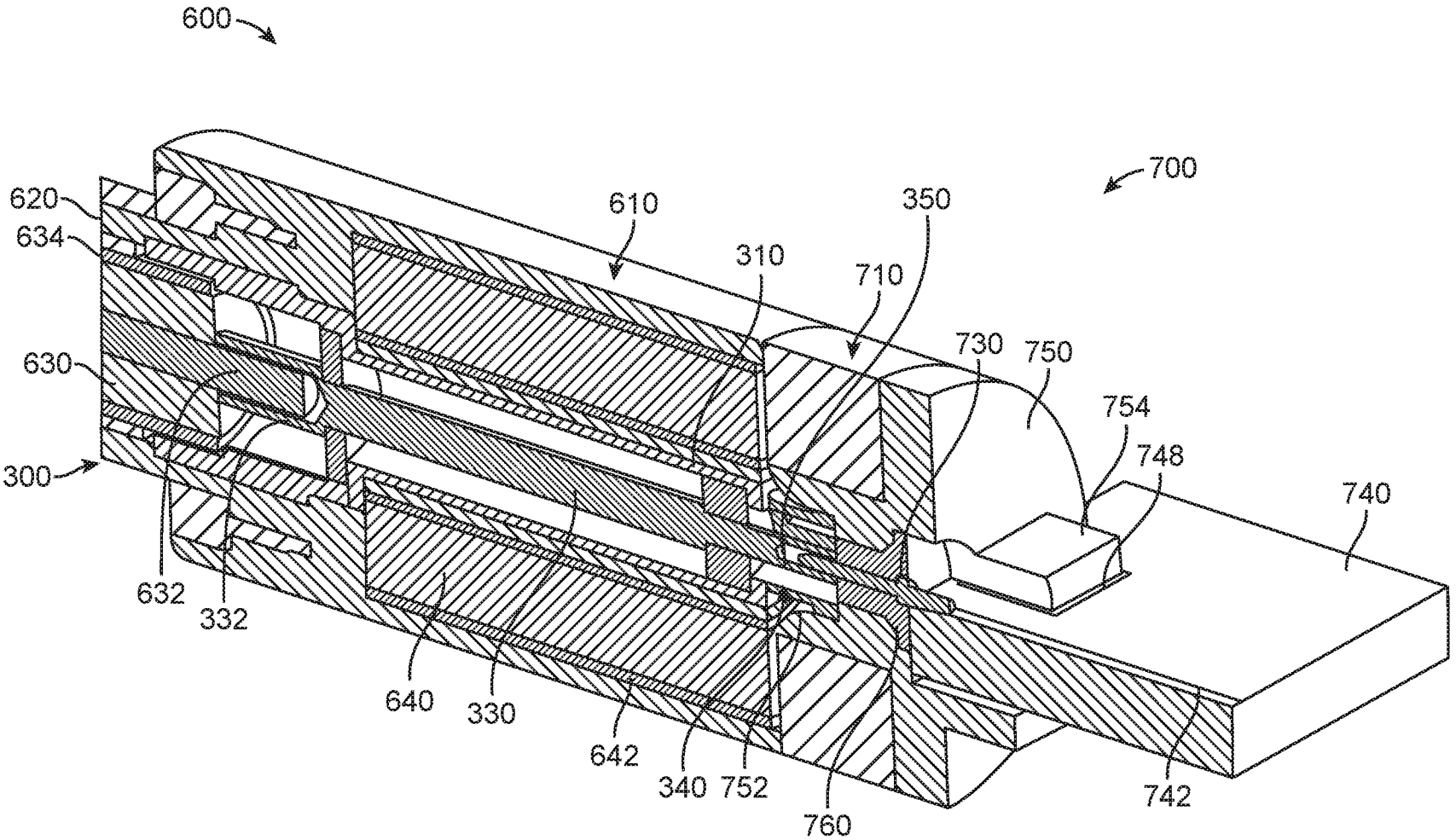
FIG. 7 illustrates a cross-section of a connector system according to an embodiment of the present invention.

FIG. 7 illustrates a cross-section of a connector system according to an embodiment of the present invention. Connector insert 600 can include a connector portion 300 having a center conductor 330 with a recess 350. The connector portion 300 can further include an outer barrel 310 positioned concentrically around the center conductor. Outer barrel 310 can terminate in tulip-shaped contact 340 around recess 350 in center conductor 330. Housing 610 can be formed concentrically around connector portion 300. Housing 610 can include one or more magnets 640 on at least one side of connector portion 300. In these and other embodiments of the present invention, one or more magnets 640 can be on at least two sides of connector portion 300. The two sides can be opposite sides. In these and other embodiments of the present invention, one or more magnets 640 can be positioned concentrically around connector portion 300. For example, one magnet 640 can be positioned concentrically around connector portion 300. The magnet 640 can have a first polarity (either North or South) at a leading edge of connector insert 600 and a second polarity at a trailing edge of connector insert 600. In these and other embodiments of the present invention, two magnets 640 can be used and they can be arranged to have opposing polarities. Magnet or magnets 640 can have a protective layer 642 on one or more sides—between the magnet 640 and housing 610, between the magnet 640 and connector portion 300, or both. In these and other embodiments of the present invention, one or more magnets 640 can instead be ferromagnetic pieces that can be attracted to one or more magnets in the connector receptacle. Outer barrel 310 and center conductor 330 of connector portion 300 can terminate in conductors in cable 630. Specifically, a trailing edge of center conductor 330 can include recess 332. Signal conductor 632 in cable 630 can inserted into recess 332 and soldered, crimped, or otherwise attached. Ground shield 634 of cable 630 can electrically connect to outer barrel 310 at a trailing edge of outer barrel 310. Cable 630 can be insulated. Cable 630 can be protected by strain relief 620.

In this example, a signal path can include conductor 632 and center conductor 330 in connector insert 600 and pin 730 and trace 742 in connector receptacle 700. A ground path can include ground shield 634 and outer barrel 310 in connector insert 600 and ground contact 750 in connector receptacle 700.

Connector receptacle 700 can include magnetic target 710 supported by ground contact 750. The magnet or magnets 640 of connector insert 600 can be attracted to magnetic target 710, which can be made of a ferromagnetic material. In these and other embodiments of the present invention, the magnet or magnets 640 of connector insert 600 can instead be ferromagnetic pieces and magnetic target 710 can be, or can include, one or more magnets. Ground contact 750 can include tabs 754. Tabs 754 can be soldered, glued, or otherwise in contact with or attached to board 740. Ground contact 750 can have a passage for pin 730. The passage can include a concentric insulator 760 around a portion of pin 730. The passage in ground contact 750 can also accept contact 340 of connector insert 600 to provide a ground path. A front opening of the passage formed by ground contact 750 can include taper 752. Taper 752 can guide contact 340 into the passage during mating of connector insert 600 and connector receptacle 700. This can simplify the insertion process and improve the overall user experience.

Pin 730 can be inserted in recess 350 of center conductor 330 of connector portion 300 when connector insert 600 and connector receptacle 700 are mated. This penetrating connection can stand in contrast to other connectors where a surface connection can be made. The pin 730 can terminate on a board 740 in an electronic device. Ground contact 750 can also terminate on board 740.

The combination of the penetrating connection between pin 730 and recess 350 of center conductor 330, along with the magnetic attraction between connector insert 600 and connector receptacle 700, can provide a stable and consistent connection with little reflection and good impedance characteristics. More specifically, magnet 640 in connector insert 100 can be attracted to magnetic target 710 in connector receptacle 200. Pin 730 of connector receptacle 200 can penetrate center conductor 330 of connector portion 300 in connector insert 600 without the need of turning or tightening. Magnet or magnets 640 can fix a position to magnetic target 710 of connector receptacle 700 in a consistent and stable manner. The penetration of pin 730 into recess 350 in center conductor 330 of connector portion 300 can provide a signal path having good impedance matching. The magnetic attraction of connector insert 600 to connector receptacle 700 can provide a good user experience.

In these and other embodiments of the present invention, magnetic target 710 can be formed of a ferromagnetic material that can attract magnets 640, it can be formed of one or more magnets, or it can be a combination of these. In these and other embodiments of the present invention, the magnet or magnets 640 of connector insert 600 can instead be ferromagnetic pieces that are attractive to magnets in connector receptacle 700, or magnets can be located in both connector insert 600 and connector receptacle 700.

Figure 8:
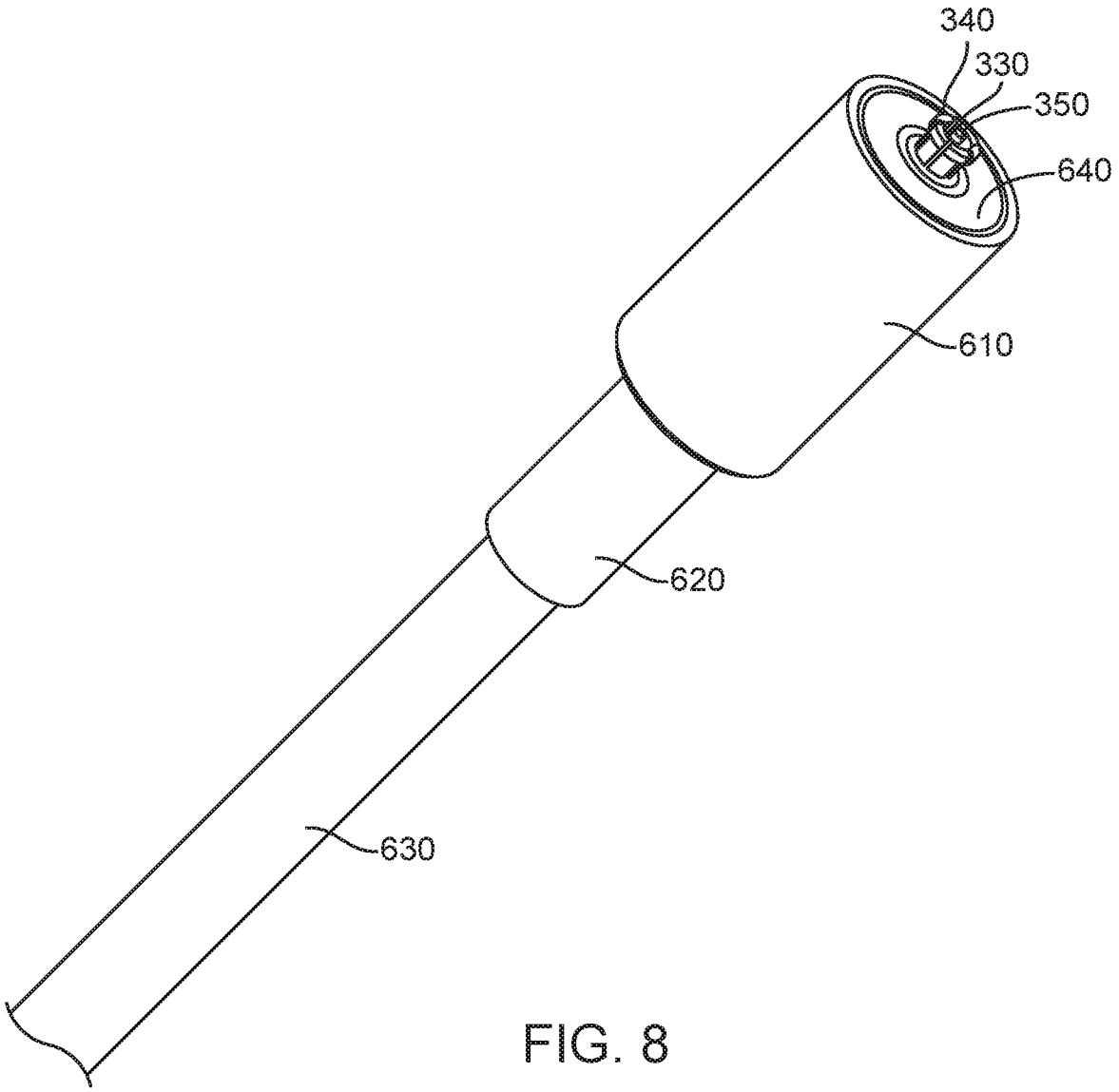
FIG. 8 illustrates a connector insert according to an embodiment of the present invention.

FIG. 8 illustrates a connector insert according to an embodiment of the present invention. Center conductor 330 can include central recess 350 and can be surrounded by tulip-shaped contact 340. Housing 610 can be around magnet 640. Magnet 640 can be protected with a coating or other layer. Connector insert 600 and connector receptacle 700 can be arranged to provide a protective spacing between them for magnet 640. Cable 630 can be protected by strain relief 620.

Figure 9:
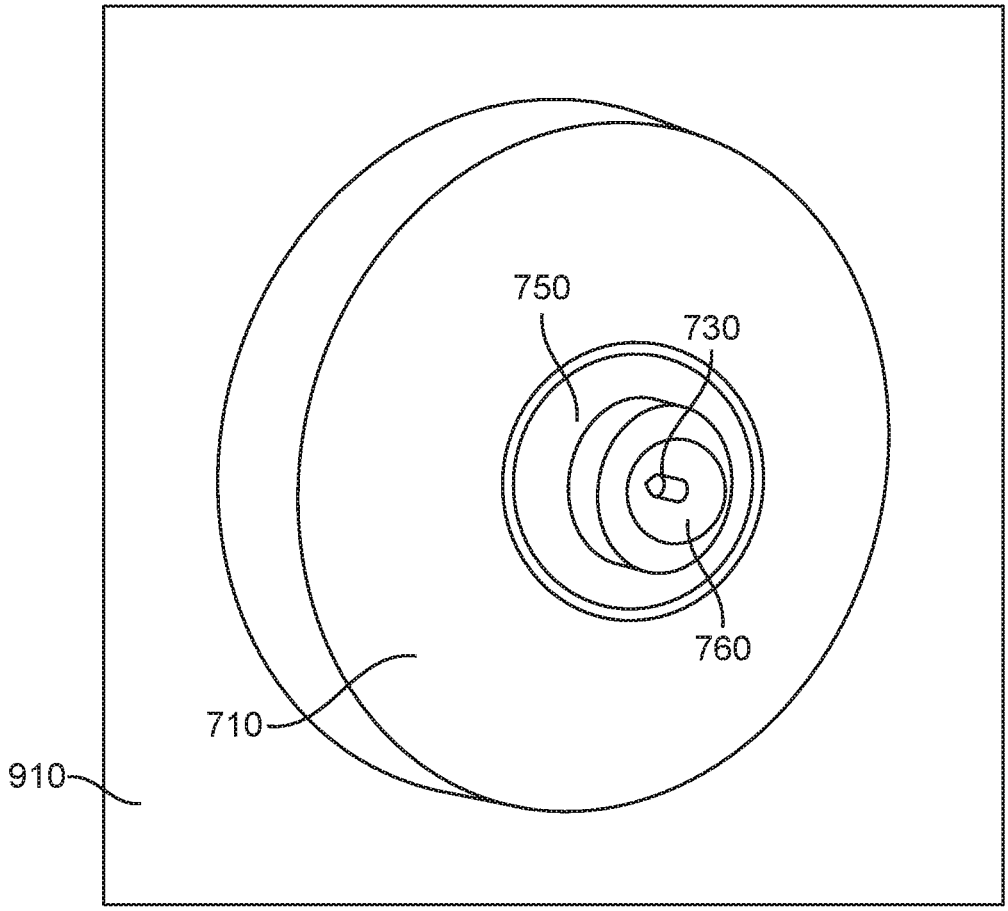
FIG. 9 illustrates a connector receptacle according to an embodiment of the present invention.

FIG. 9 illustrates a connector receptacle according to an embodiment of the present invention. An additional housing 910 can provide access to magnetic target 710, which can have an opening for ground contact 750, pin 730, and insulator 760.

Figure 10:
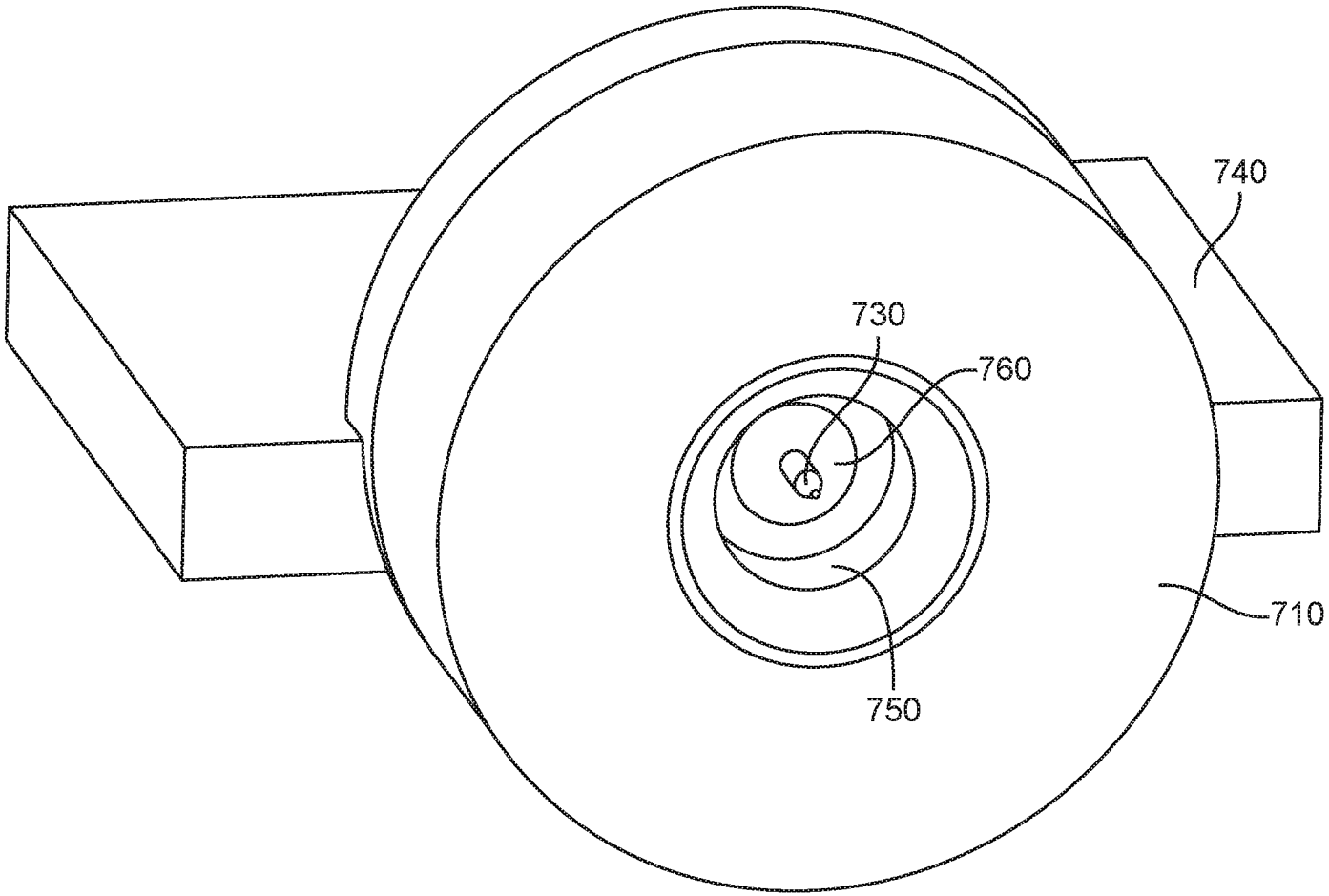
FIG. 10 illustrates a portion of a connector receptacle according to an embodiment of the present invention.

FIG. 10 illustrates a portion of a connector receptacle according to an embodiment of the present invention. In this example, additional housing 910 has been removed to show magnetic target 710, ground contact 750, pin 730, and insulator 760. Pin 730 can connect to trace 742 (shown in FIG. 7) on board 740.

Figure 11:
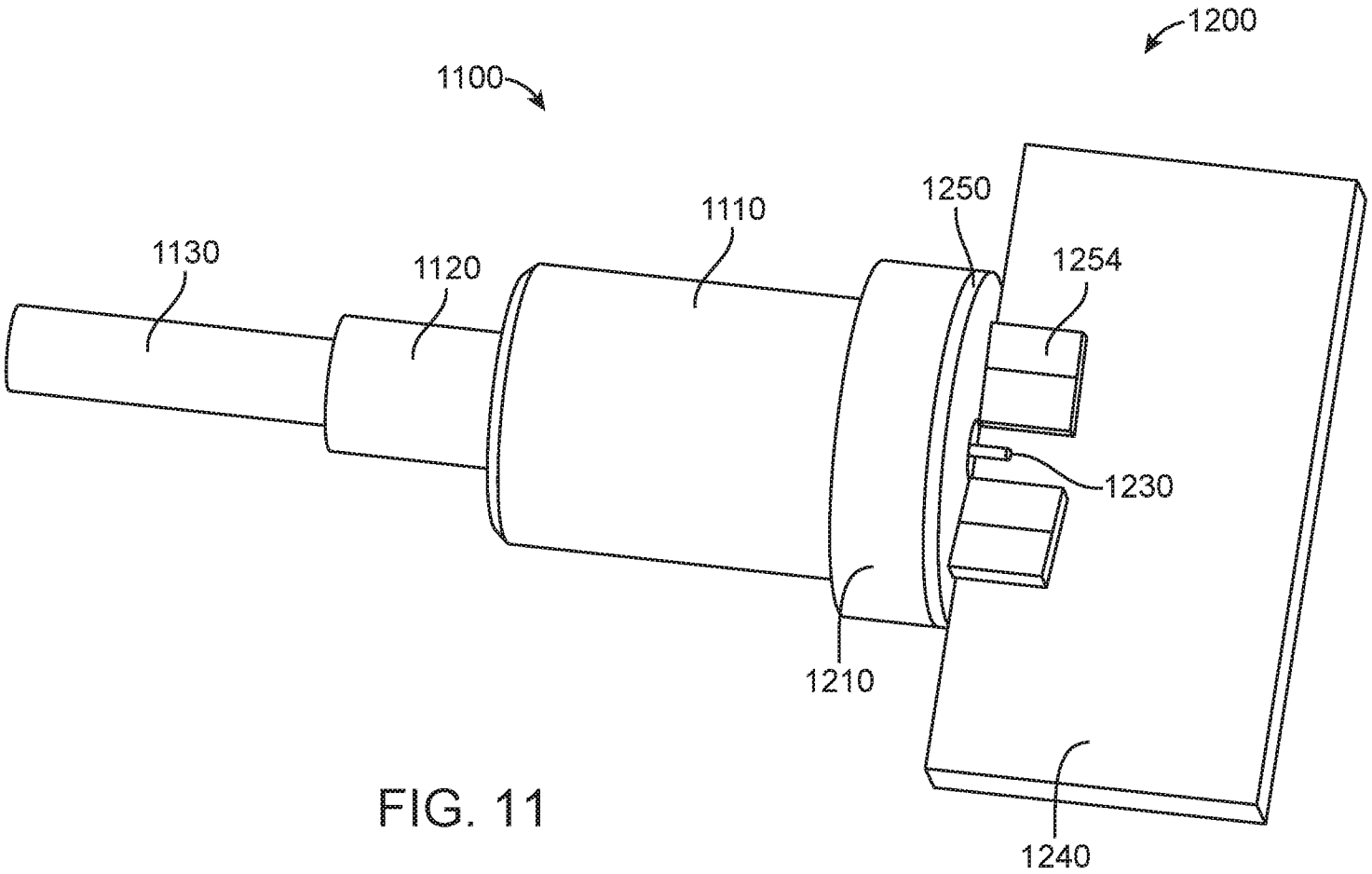
FIG. 11 illustrates a connector system according to an embodiment of the present invention.

FIG. 11 illustrates a connector system according to an embodiment of the present invention. This illustrative embodiment of the present invention can provide a connector system including connector insert 1100 and connector receptacle 1200. Connector insert 1100 and connector receptacle 1200 can be substantially similar to connector inserts 100 and 600 and connector receptacles 200 and 700 in the above examples, with various modifications, some of which are described below.

Connector insert 1100 can include housing 1110 and cable 1130. Cable 1130 can be protected by strain relief 1120. Connector receptacle 1200 can include magnetic target 1210, pin 1230, board 1240, and ground contact 1250. Pin 1230 can connect to a trace (not shown) on board 1240. Ground contact 1250 can include tabs 1254, which can electrically connect to ground traces or planes (not shown) on board 1240. In these and other embodiments of the present invention, magnetic target 1210 can have a larger radius than connector insert housing 1110. This can help users to attach connector insert 1100 to magnetic target 1210 and improve the user experience. More details of this connector system are shown in the following figure.

Figure 12:
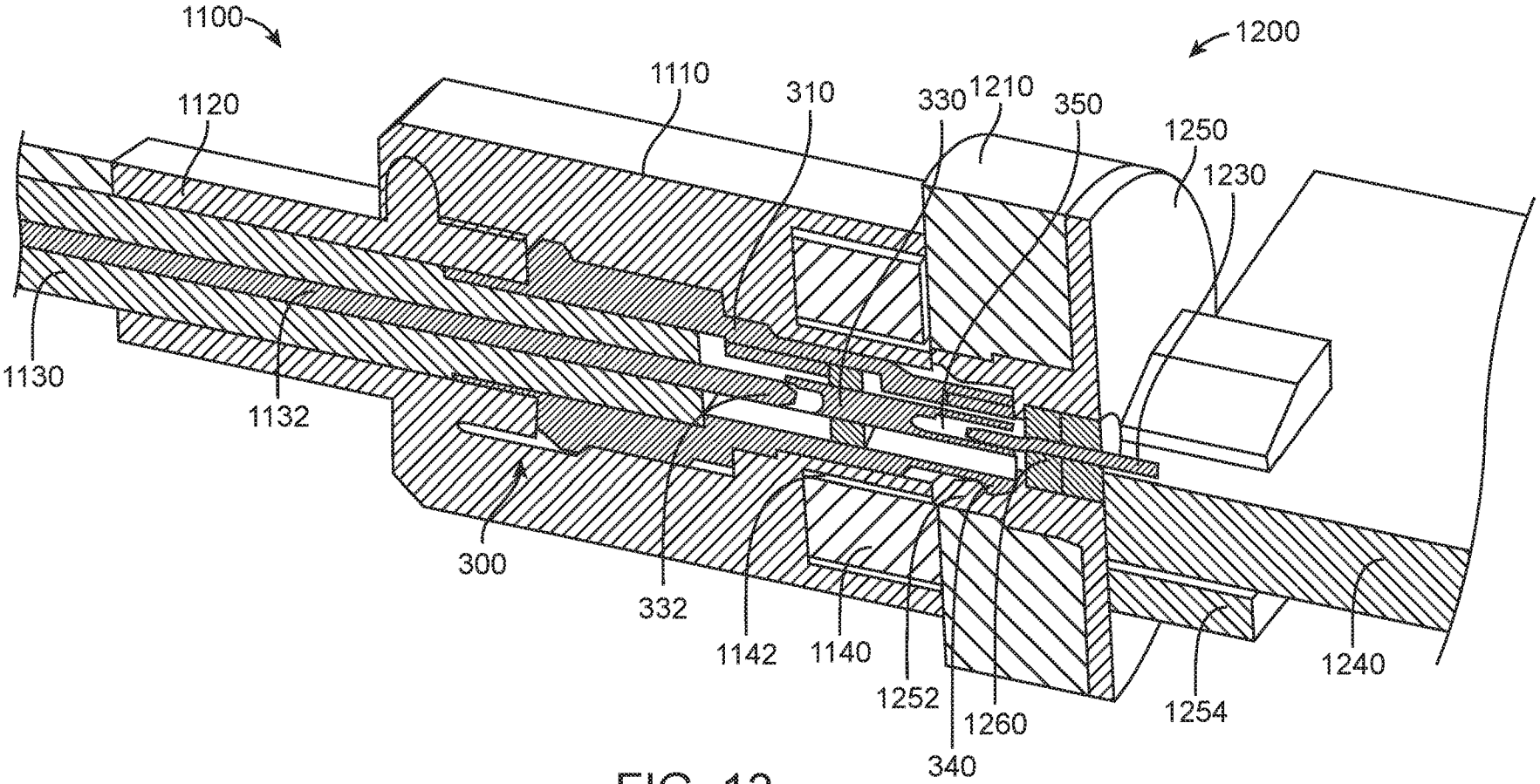
FIG. 12 illustrates a cross-section of a connector system according to an embodiment of the present invention.

FIG. 12 illustrates a cross-section of a connector system according to an embodiment of the present invention. Connector insert 1100 can include a connector portion 300 having a center conductor 330 with a recess 350. The connector portion 300 can further include an outer barrel 310 positioned concentrically around the center conductor. Outer barrel 310 can terminate in tulip-shaped contact 340 around recess 350 in center conductor 330. Housing 1110 can be formed concentrically around connector portion 300. Housing 1110 can include one or more magnets 1140 on at least one side of connector portion 300. Relative to magnets 640 in connector insert 600 (shown in FIG. 7), magnets 1140 can have a shorter length and be located around a front of connector portion 300. This can help to reduce a diameter of connector insert 1100. This reduction can allow the relative diameter of magnetic target 1210 to be larger, thereby improving a user experience. In these and other embodiments of the present invention, one or more magnets 1140 can be on at least two sides of connector portion 300. The two sides can be opposite sides. In these and other embodiments of the present invention, one or more magnets 1140 can be positioned concentrically around connector portion 300. For example, one magnet 1140 can be positioned concentrically around connector portion 300. The magnet 1140 can have a first polarity (either North or South) at a leading edge of connector insert 1100 and a second polarity at a trailing edge of connector insert 1100. In these and other embodiments of the present invention, two magnets 1140 can be used and they can be arranged to have opposing polarities. Magnet or magnets 1140 can have a protective layer 1142 on one or more sides—between the magnet 1140 and housing 1110, between the magnet 1140 and connector portion 300, or both. In these and other embodiments of the present invention, one or more magnets 1140 can instead be ferromagnetic pieces that can be attracted to one or more magnets in the connector receptacle. Outer barrel 310 and center conductor 330 of connector portion 300 can terminate in conductors in cable 1130. Specifically, a trailing edge of center conductor 330 can include recess 332. Signal conductor 1132 in cable 1130 can inserted into recess 332 and soldered, crimped, or otherwise attached. A ground shield (not shown) of cable 1130 can electrically connect to outer barrel 310 at a trailing edge of outer barrel 310. Cable 1130 can be insulated. Cable 1130 can be protected by strain relief 1120.

In this example, a signal path can include conductor 1132 and center conductor 330 in connector insert 1100 and pin 1230 and a trace (not shown) on board 1240 in connector receptacle 1200. A ground path can include a shield (not shown) around cable 1130 and outer barrel 310 in connector insert 1100, as well as ground contact 1250, ground contact tabs 1254, and ground paths (not shown) on board 1240 in connector receptacle 1200.

Connector receptacle 1200 can include magnetic target 1210 supported by ground contact 1250. The magnet or magnets 1140 of connector insert 1100 can be attracted to magnetic target 1210, which can be made of a ferromagnetic material. In these and other embodiments of the present invention, the magnet or magnets 1140 of connector insert 1100 can instead be ferromagnetic pieces and magnetic target 1210 can be, or can include, one or more magnets. Ground contact 1250 can include tabs 1254. Tabs 1254 can be soldered, glued, or otherwise in contact with or attached to board 1240. Ground contact 1250 can have a passage for pin 1230. The passage can include a concentric insulator 1260 around a portion of pin 1230. The passage in ground contact 1250 can also accept contact 340 of connector insert 1100 to provide a ground path. A front opening of the passage formed by ground contact 1250 can include taper 1252. Taper 1252 can guide contact 340 into the passage during mating of connector insert 1100 and connector receptacle 1200. This can simplify the insertion process to help reduce damage to contact 340 and improve the overall user experience.

Pin 1230 can be inserted in recess 350 of center conductor 330 of connector portion 300 when connector insert 1100 and connector receptacle 1200 are mated. This penetrating connection can stand in contrast to other connectors where a surface connection can be made. The pin 1230 can terminate on a board 1240 in an electronic device. Ground contact 1250 can also terminate on board 1240 at tabs 1254. Tabs 1254 can be connected to ground traces or planes (not shown) on board 1240.

The combination of the penetrating connection between pin 1230 and recess 350 of center conductor 330, along with the magnetic attraction between connector insert 1100 and connector receptacle 1200, can provide a stable and consistent connection with little reflection and good impedance characteristics. More specifically, magnet 1140 in connector insert 100 can be attracted to magnetic target 1210 in connector receptacle 200. Pin 1230 of connector receptacle 200 can penetrate center conductor 330 of connector portion 300 in connector insert 1100 without the need of turning or tightening. Magnet or magnets 1140 can fix a position to magnetic target 1210 of connector receptacle 1200 in a consistent and stable manner. The penetration of pin 1230 into recess 350 in center conductor 330 of connector portion 300 can provide a signal path having good impedance matching. The magnetic attraction of connector insert 1100 to connector receptacle 1200 can provide a good user experience and a stable connection.

In these and other embodiments of the present invention, magnetic target 1210 can be formed of a ferromagnetic material that can attract magnets 1140, it can be formed of one or more magnets, or it can be a combination of these. In these and other embodiments of the present invention, the magnet or magnets 1140 of connector insert 1100 can instead be ferromagnetic pieces that are attractive to magnets in connector receptacle 1200, or magnets can be located in both connector insert 1100 and connector receptacle 1200.

Figure 13:
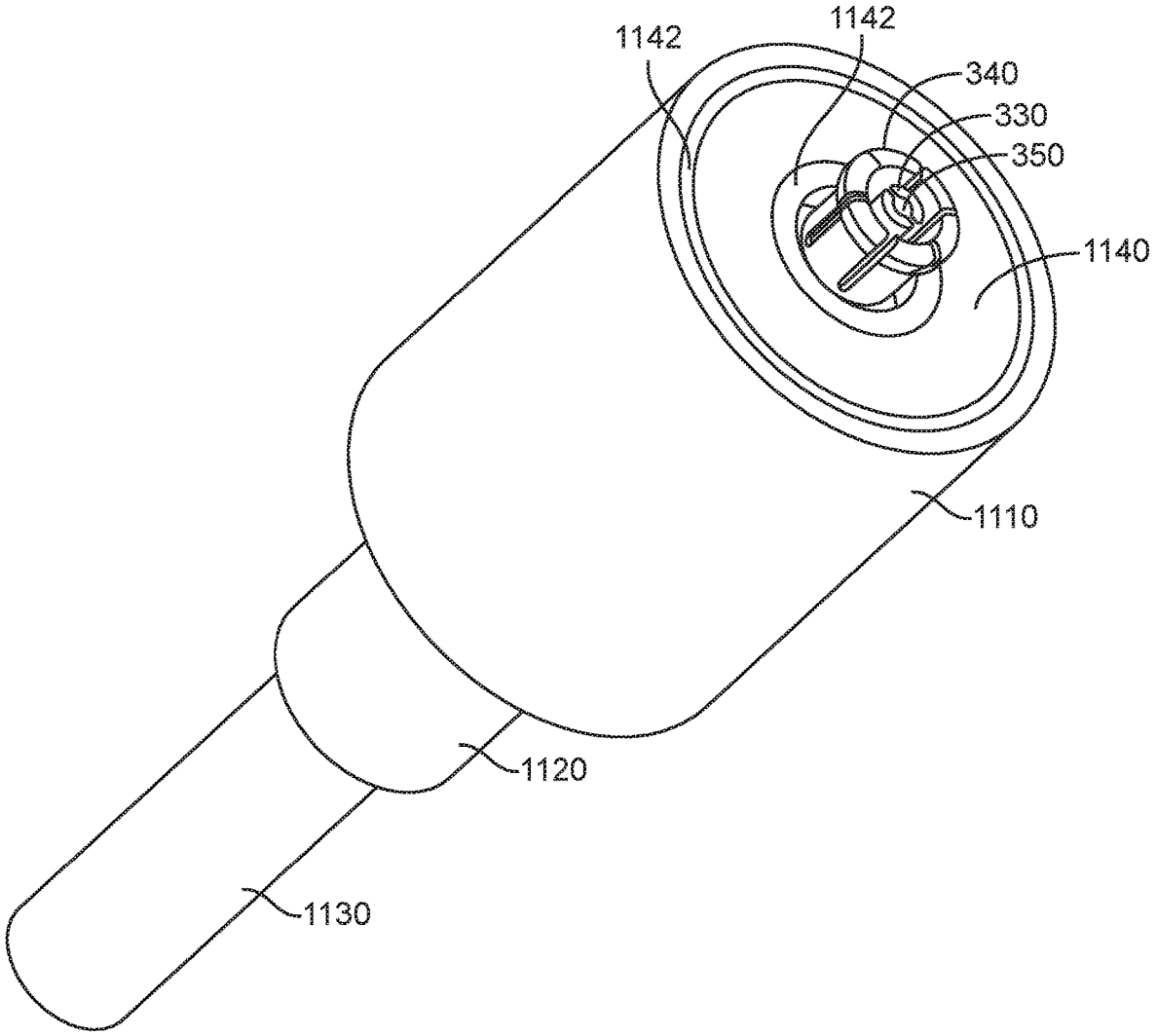
FIG. 13 illustrates a connector insert according to an embodiment of the present invention.

FIG. 13 illustrates a connector insert according to an embodiment of the present invention. Center conductor 330 can include central recess 350 and can be surrounded by tulip-shaped contact 340. Housing 1110 can be around magnet 1140. Magnet 1140 can be protected with coatings or other layers 1142. Connector insert 1100 and connector receptacle 1200 can be arranged to provide a protective spacing between them for magnet 1140. Cable 1130 can be protected by strain relief 1120.

Figure 14:
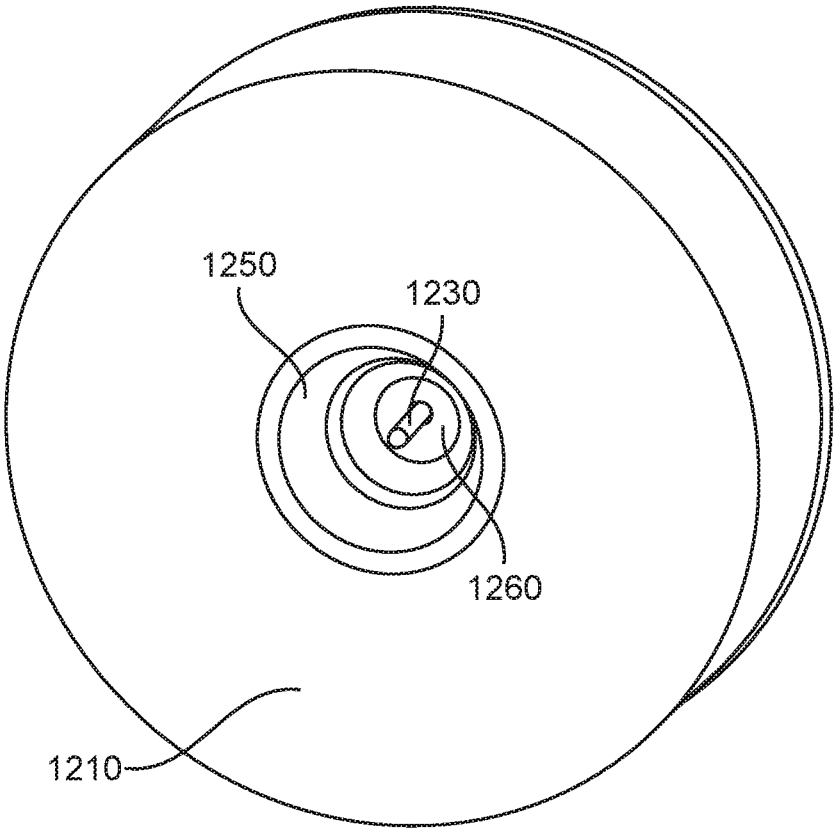
FIG. 14 illustrates a connector receptacle according to an embodiment of the present invention.

FIG. 14 illustrates a connector receptacle according to an embodiment of the present invention. Magnetic target 1210 can have an opening for ground contact 1250, pin 1230, and insulator 1260.

Figure 15:
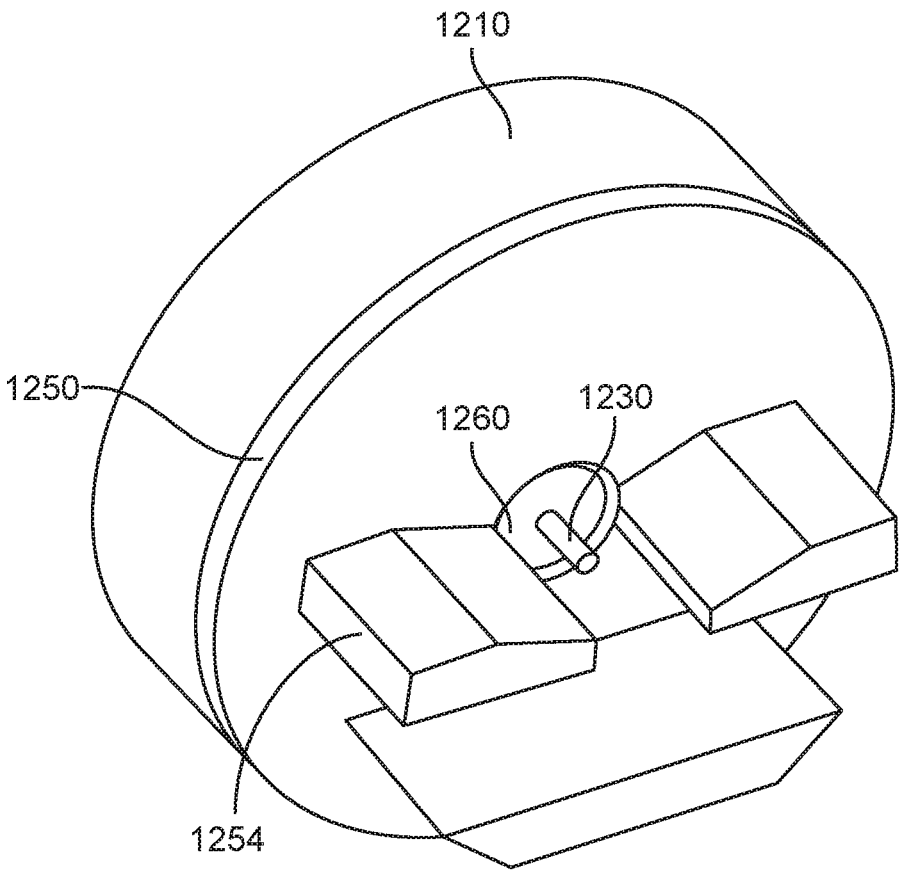
FIG. 15 illustrates a portion of a connector receptacle according to an embodiment of the present invention.

FIG. 15 illustrates a portion of a connector receptacle according to an embodiment of the present invention. Magnetic target 1210 can be supported by ground contact 1250. Pin 1230 can be surrounded by insulator 1260 and can pass through magnetic target 1210 and ground contact 1250. Tabs 1254 can extend from a rear of ground contact 1250. Pin 1230 and tabs 1254 can be connected to traces or planes on board 1240 (shown in FIG. 12.) An example is shown in the following figure.

Figure 16:
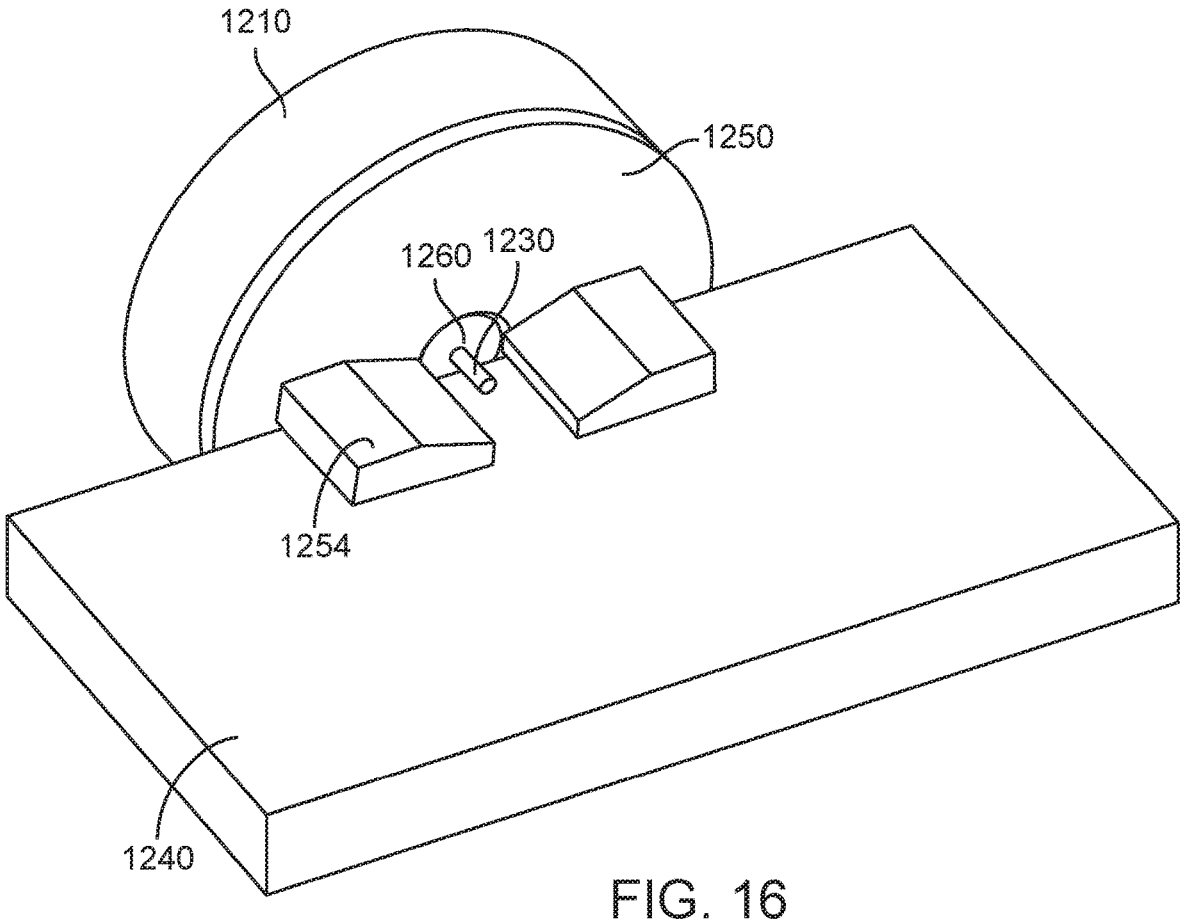
FIG. 16 illustrates a portion of a connector receptacle according to an embodiment of the present invention.

FIG. 16 illustrates a portion of a connector receptacle according to an embodiment of the present invention. Magnetic target 1210 can be supported by ground contact 1250. Pin 1230 can be surrounded by insulator 1260 and can pass through magnetic target 1210 and ground contact 1250. Tabs 1254 can extend from a rear of ground contact 1250. Pin 1230 can be connected to a signal trace (not shown) board 1240. Tabs 1254 can be soldered, glued, or otherwise attached or in contact with board 1240. Tabs 1254 can be in electrical contact with planes or traces (not shown), for example a ground plane, on board 1240.

In these and other embodiments of the present invention, the magnets can be omitted or otherwise made optional. Examples of such connectors are shown in the following figures.

Figure 17:
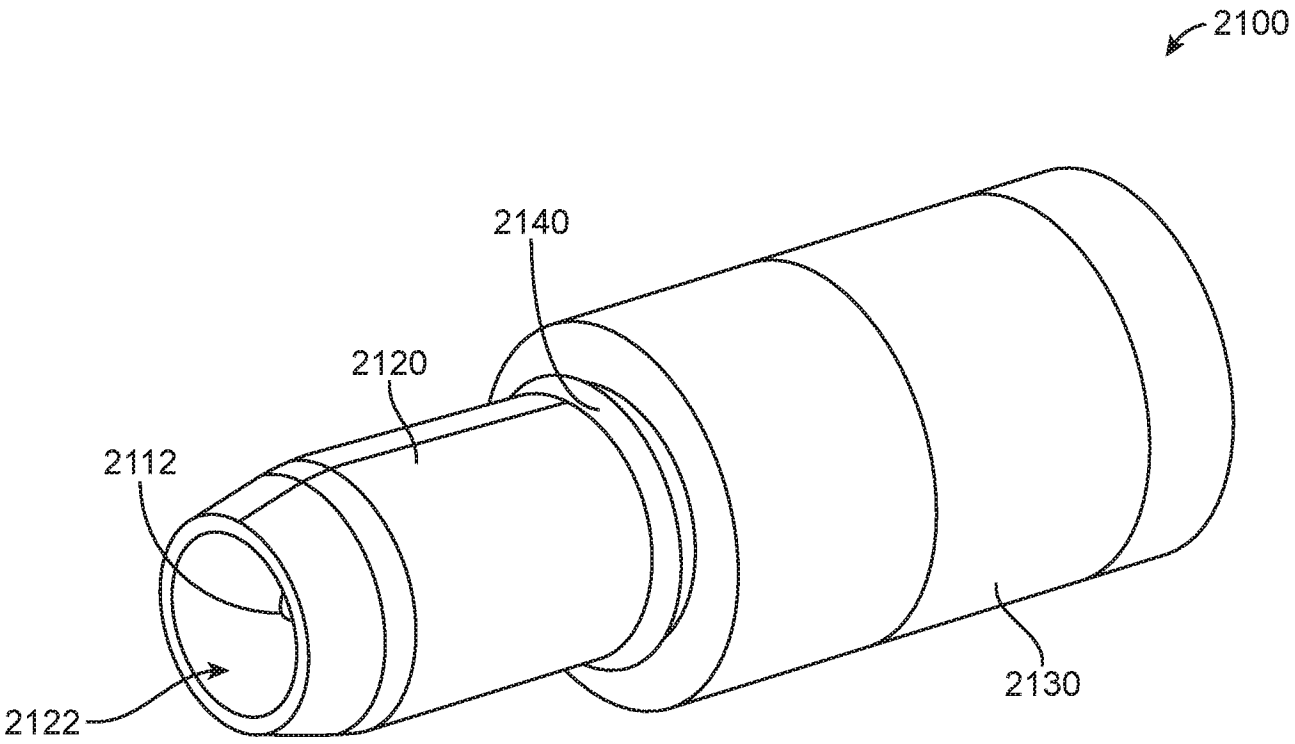
FIG. 17 illustrates a plug connector according to an embodiment of the present invention.

FIG. 17 illustrates a plug connector according to an embodiment of the present invention. Plug connector 2100 can convey a signal on pin tip 2112. Pin tip 2112 can be shielded by plug enclosure 2120. Plug enclosure 2120 can include front opening 2122 to provide access to pin tip 2112. Plug enclosure 2120 can be supported by enclosure back body 2130. When plug connector 2100 is inserted into a corresponding connector receptacle, gasket or O-ring 2140 can prevent or limit ingress of moisture into a corresponding connector receptacle 2200 (shown in FIG. 20.) A front edge of plug enclosure 2120 can be tapered to improve the alignment of pin tip 2112 to contact portion 2212 of tulip pin 2210 in connector receptacle 2200 (shown in FIG. 21) when plug connector 2100 is inserted into connector receptacle 2200.

Figure 18:
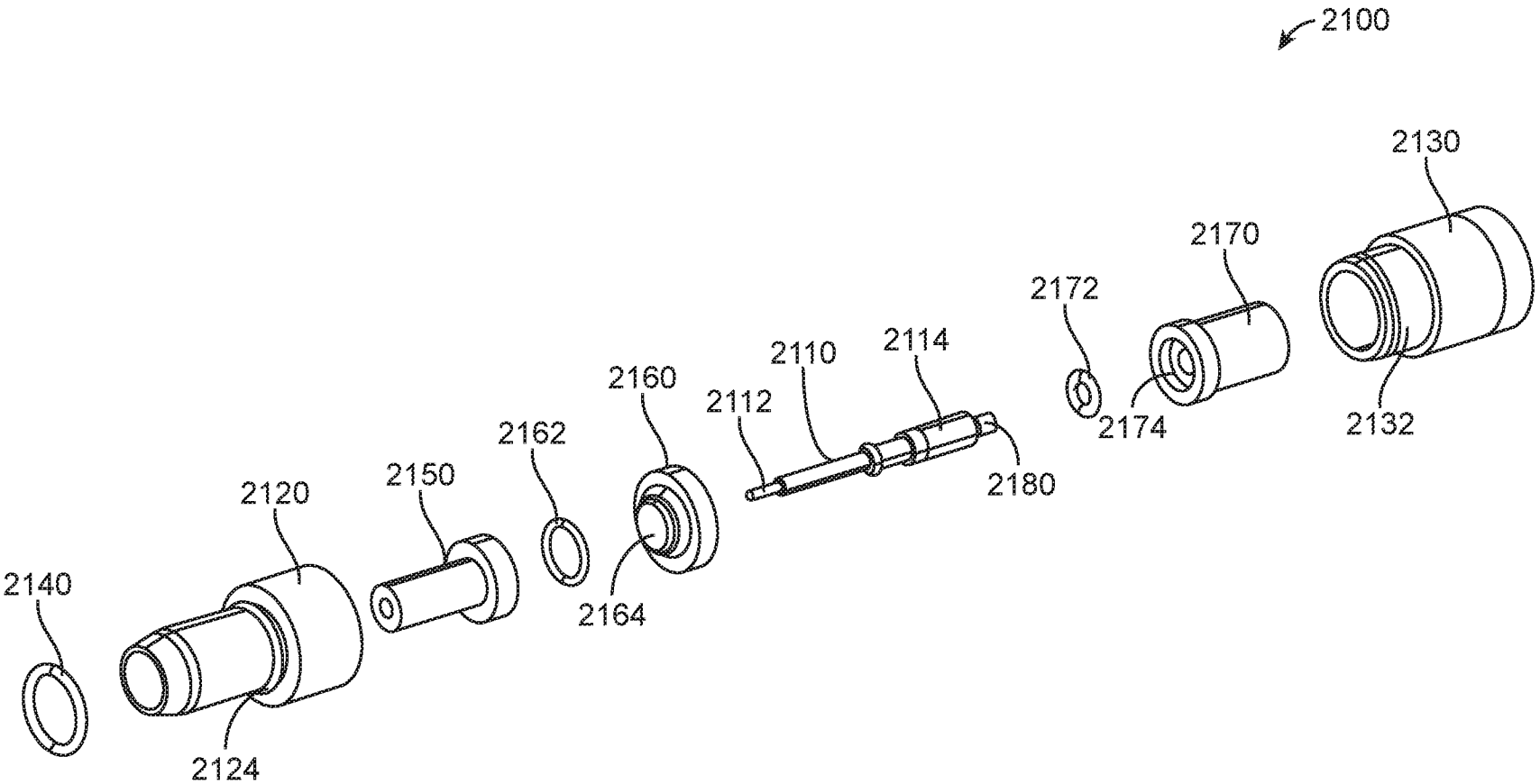
FIG. 18 is an exploded view of a plug connector according to an embodiment of the present invention.

FIG. 18 is an exploded view of a plug connector according to an embodiment of the present invention. Plug connector 2100 can include plug enclosure 2120. Plug enclosure 2120 can include notch 2124. Notch 2124 can retain gasket or O-ring 2140. Signal pin 2110 can include pin tip 2112 and connecting portion 2114. Connection 2180 can be attached to connecting portion 2114 of signal pin 2110. Signal pin 2110 can be insulated from plug enclosure 2120 and enclosure back body 2130 by insulating housing 2150 and insulating housing 2170. Enclosure portion 2160 can fit over insulating housing 2150. Gasket or O-ring 2162 can be fit over a front portion 2164 of enclosure portion 2160. Gasket or O-ring 2172 can be placed in recess 2174 of insulating housing 2170. Gasket or O-ring 2172 can form a seal between insulating housing 2150 and insulating housing 2170. Enclosure back body 2130 can be fit over insulating housing 2170 such that a front portion 2132 of enclosure back body 2130 can be fit in a rear of plug enclosure 2120.

Plug enclosure 2120 and enclosure back body 2130 can be formed of conductive metal such as stainless steel, or other appropriate material. Signal pin 2110 can be formed of copper, bronze, nickel, beryllium copper, or other conductive material. Signal pin 2110 can be plated with gold, nickel, or other material to improve corrosion performance and reduce resistance. Insulating housing 2150, insulating housing 2170, and enclosure portion 2160 can be formed of plastic, nylon, polytetrafluoroethylene, or other non-conductive material. Gasket or O-ring 2162, gasket or O-ring 2172, and gasket or O-ring 2140 can be formed of silicone, rubber, silicon rubber, or other elastomeric or pliable material. In these and other embodiments of the present invention, one or more magnets can also be included. For example, some or all of plug enclosure 2120 and enclosure back body 2130 can be formed of magnets or can otherwise be magnetic.

Figure 19:
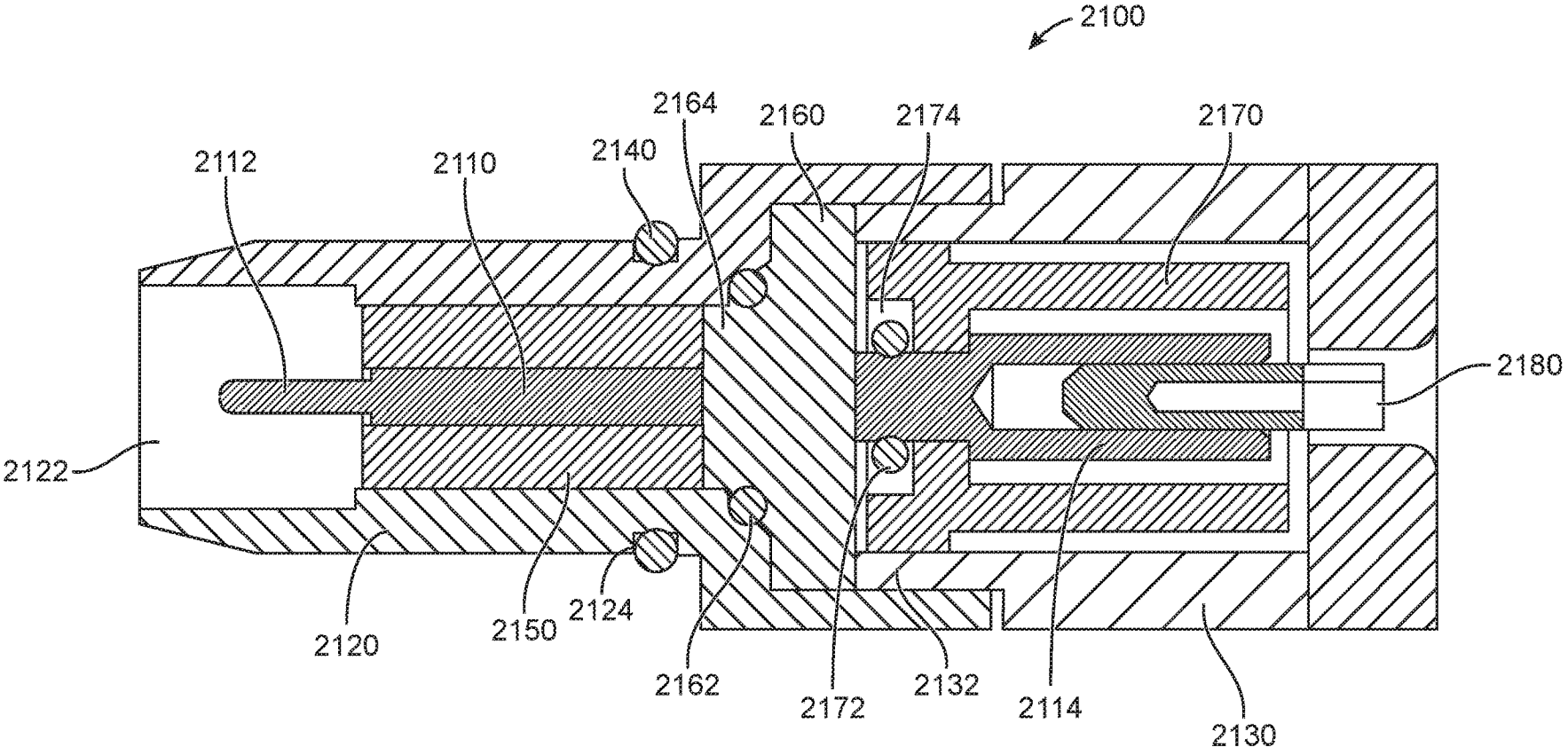
FIG. 19 illustrates a cross-section of a plug connector according to an embodiment of the present invention.

FIG. 19 illustrates a cross-section of a plug connector according to an embodiment of the present invention. Signal pin 2110 can include pin tip 2112 and connecting portion 2114. Connection 2180 can be inserted or otherwise fit into connecting portion 2114. A wire or other conductor (not shown) can connect to, or be a portion of, connection 2180. Signal pin 2110 can be insulated from plug enclosure and enclosure back body by insulating housing 2150 and insulating housing 2170. Enclosure portion 2160 can be fit over a front of insulating housing 2150. Gasket or O-ring 2172 can fit in recess 2174 in insulating housing 2170 to form a seal between insulating housing 2150 and insulating housing 2170. Gasket or O-ring 2162 can fit around front portion 2164 of enclosure portion 2160 to form a seal between plug enclosure 2120 and enclosure portion 2160. Gasket or O-ring 2140 can fit in notch 2124 to form a seal between plug enclosure 2120 and a corresponding connector receptacle when plug connector 2100 is inserted into corresponding connector receptacle 2200, shown in FIG. 20. Plug enclosure 2120 can include front opening 2122 to provide access to pin tip 2112. Front portion 2132 of enclosure back body 2130 can fit in a rear of plug enclosure 2120.

Figure 20:
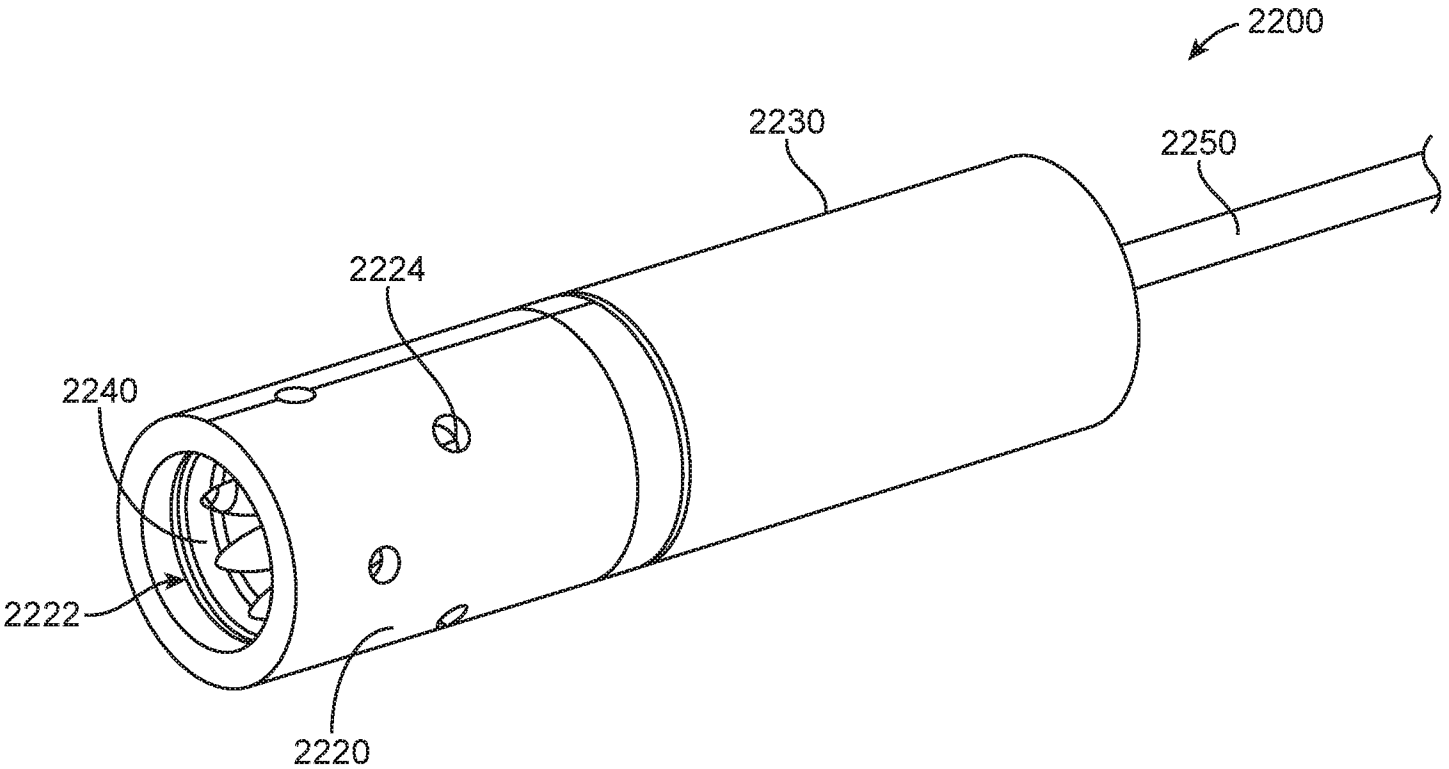
FIG. 20 illustrates a connector receptacle that can be mated with the plug connector of FIG. 17.

FIG. 20 illustrates a connector receptacle that can be mated with the plug connector of FIG. 17. Connector receptacle 2200 can include enclosure 2220 having a front opening 2222 and drip holes 2224. Enclosure 2220 can be attached to back enclosure 2230. Cable 2250 can be attached at a rear of back enclosure 2230. Front opening 2222 in enclosure 2220 can provide access to perimeter spring 2240 and to face spring 2260, as shown in the following figure.

Figure 21:
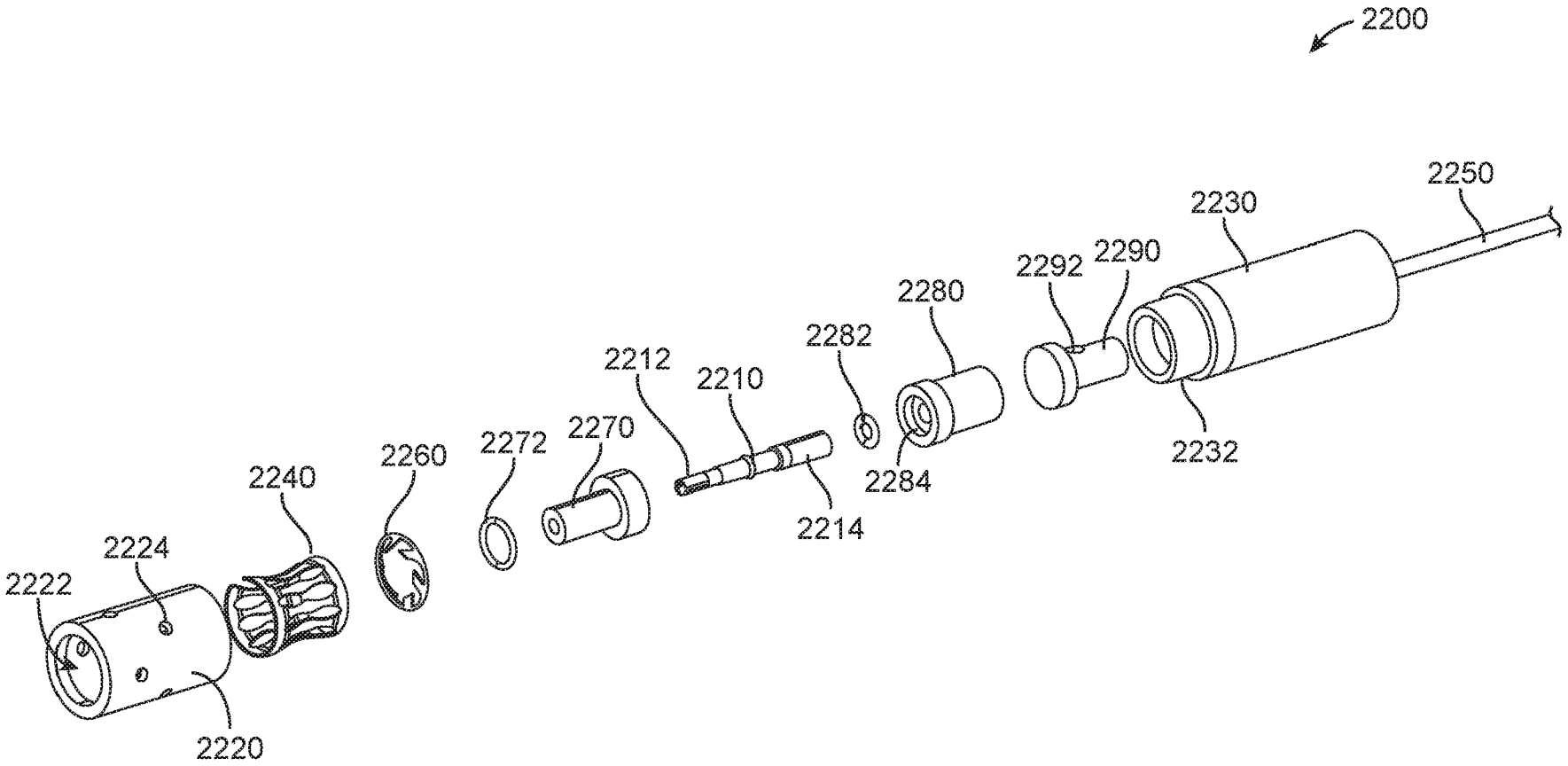
FIG. 21 is an exploded view of a connector receptacle according to an embodiment of the present invention.

FIG. 21 is an exploded view of a connector receptacle according to an embodiment of the present invention. Connector receptacle 2200 can include enclosure 2220 and back enclosure 2230. Front portion 2232 of back enclosure 2230 can fit in a rear of enclosure 2220. Enclosure 2220 and back enclosure 2230 can surround and shield tulip pin 2210. Tulip pin 2210 can include connecting portion 2214, which can accept a conductor 2252 (shown in FIG. 24) in cable 2250, and contact portion 2212, which can mate with pin tip 2112 (shown in FIG. 17.) Tulip pin 2210 can be isolated from enclosure 2220 and back enclosure 2230 by insulating housing 2270 and insulating housing 2280. Gasket or O-ring 2282 can fit in recess 2284 in insulating housing 2280 to seal insulating housing 2270 to insulating housing 2280. Cable crimp 2290 can accept a conductor and braiding (not shown) from cable 2250. Solder (not shown) can be applied in opening 2292 in cable crimp 2290 to solder the braiding of cable 2250 to cable crimp 2290. Gasket or O-ring 2272 can be fit around a front portion of insulating housing 2270 to form a seal with front portion 2232 of back enclosure 2230. Perimeter spring 2240 and face spring 2260 can contact plug enclosure 2120 of corresponding plug connector 2100 (shown in FIG. 17) when plug connector 2100 is inserted into connector receptacle 2200. Front opening 2222 in enclosure 2220 can provide access to perimeter spring 2240, face spring 2260, and contact portion 2212 of tulip pin 2210. Enclosure 2220 can further include drip holes 2224.

Enclosure 2220 and back enclosure 2230 can be formed of conductive metal such as stainless steel, or other appropriate material. Tulip pin 2210 can be formed of copper, bronze, nickel, beryllium copper, or other conductive material. Tulip pin 2210 can be plated with gold, nickel, or other material to improve corrosion performance and reduce resistance. Insulating housing 2270 and insulating housing 2280 can be formed of plastic, polytetrafluoroethylene, nylon, or other non-conductive material. Perimeter spring 2240 and face spring 2260 can be formed of sheet metal, copper beryllium, stainless steel, or other conductive material. Cable crimp 2290 can be formed of steel, brass, or other solderable material. Gasket or O-ring 2272, gasket or O-ring 2282, and gasket or O-ring 2140 can be formed of silicone, rubber, silicon rubber, or other elastomeric or pliable material. In these and other embodiments of the present invention, one or more magnets can also be included. For example, some or all of plug enclosure 2120 and enclosure back body 2130 can be formed of magnets or can otherwise be magnetic.

Figure 22:
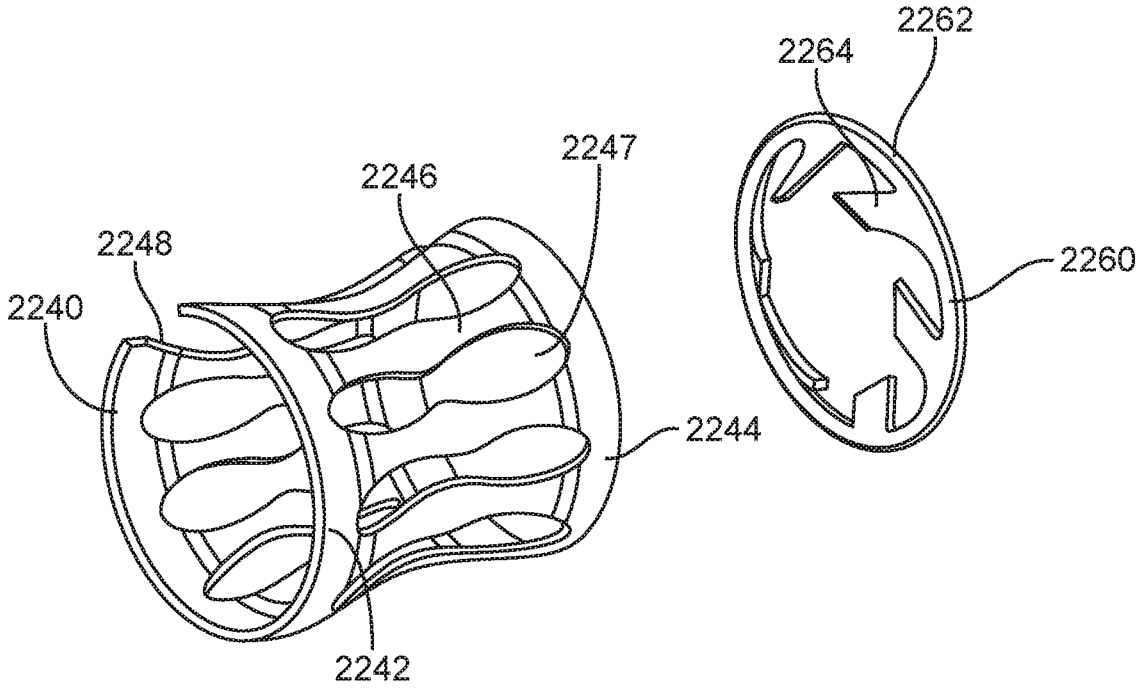
FIG. 22 illustrates a perimeter spring and a face spring according to an embodiment of the present invention.

FIG. 22 illustrates a perimeter spring and a face spring according to an embodiment of the present invention. Perimeter spring 2240 can include front band 2242 and back band 2244. Deflecting members or cross-members 2246 can extend from front band 2242 to back band 2244 and can be separated by slots or openings 2247. A break 2248 can be placed in either or both front band 2242 and back band 2244 to allow expansion and contraction of perimeter spring 2240 as plug connector 2100 (shown in FIG. 17) is inserted and removed from connector receptacle 2200 (shown in FIG. 20.) Face spring 2260 can include teeth 2264 extending from ring 2262. Teeth 2264 can be clocked or angled relative to an inside surface of ring 2262. Teeth 2264 can be angled or tilted away from a plane defined by ring 2262 in a direction towards perimeter spring 2240. Teeth 2264 can have an increased spacing along an inside surface of ring 2262. This increased spacing can help to reduce the buildup of debris and particulates that could otherwise foul face spring 2260.

Figure 23:
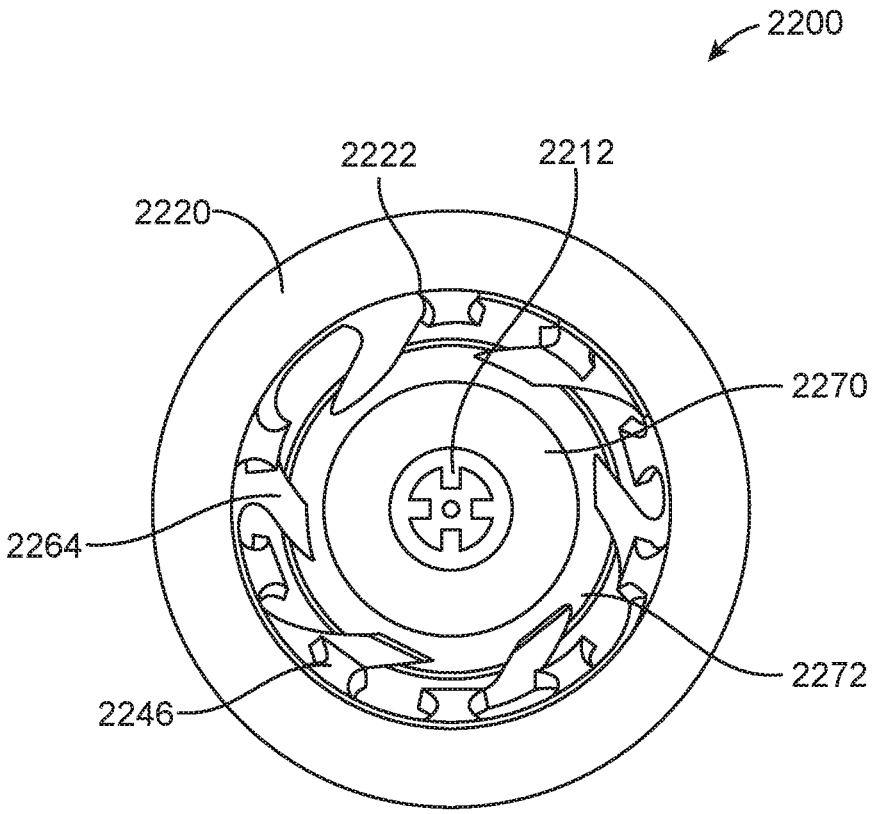
FIG. 23 illustrates a front view of a connector receptacle according to an embodiment of the present invention.

FIG. 23 illustrates a front view of a connector receptacle according to an embodiment of the present invention. In this example, front opening 2222 in enclosure 2220 can provide access to contact portion 2212 of tulip pin 2210 (shown in FIG. 21.) Insulating housing 2270 can isolate tulip pin 2210 from enclosure 2220. Gasket or O-ring 2272 can be around a portion of insulating housing 2270. Cross-members 2246 of perimeter spring 2240 (shown in FIG. 22) and teeth 2264 of face spring 2260 (shown in FIG. 22) are also exposed in front opening 2222. As plug connector 2100 (shown in FIG. 17) is inserted into front opening 2222 in connector receptacle 2200, sides of plug enclosure 2120 (shown in FIG. 17) can contact cross-members 2246 of perimeter spring 2240, while a front tip of plug enclosure 2120 can contact teeth 2264 of face spring 2260.

Figure 24:
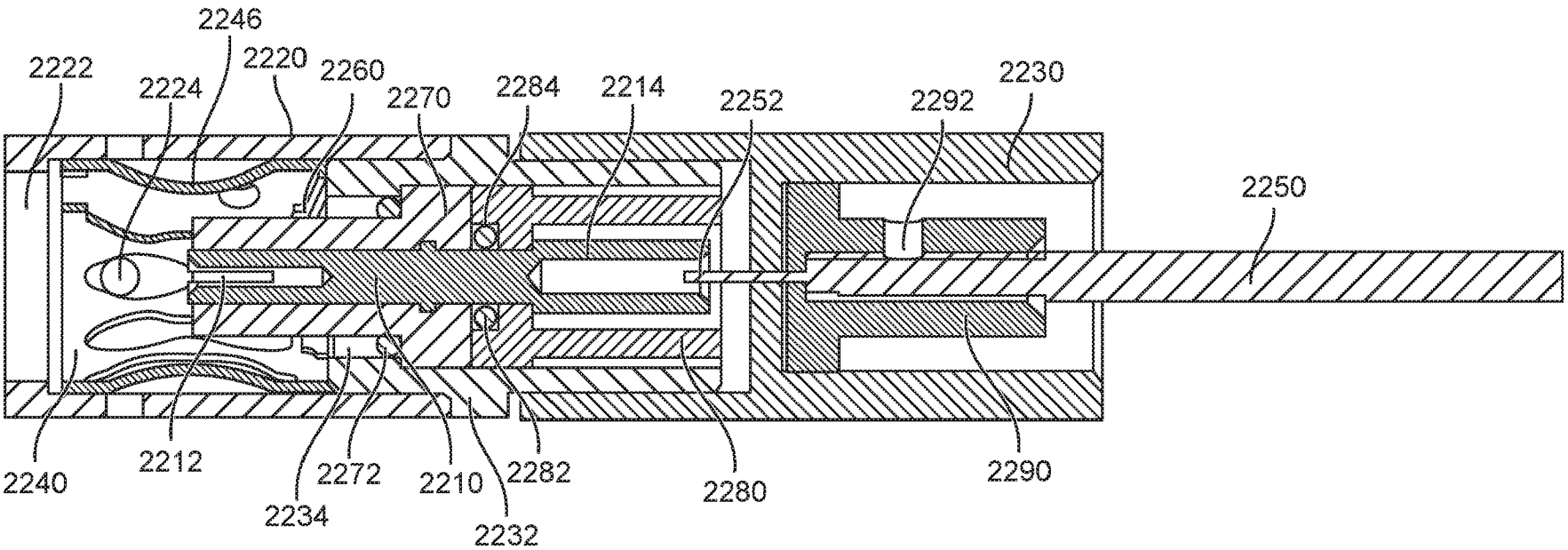
FIG. 24 illustrates a cross-section of a connector receptacle according to an embodiment of the present invention.

FIG. 24 illustrates a cross-section of a connector receptacle according to an embodiment of the present invention. Enclosure 2220 can include front opening 2222 to provide access to perimeter spring 2240, face spring 2260, and contact portion 2212 of tulip pin 2210. Tulip pin 2210 can further include connecting portion 2214 for accepting a conductor 2252 of cable 2250. Cable crimp 2290 can be soldered to a braiding (not shown) of cable 2250 by solder applied through opening 2292 in cable crimp 2290. Front portion 2232 of back enclosure 2230 can be fit in a rear of enclosure 2220. Tulip pin 2210 can be isolated from enclosure 2220 and back enclosure 2230 by insulating housing 2270 and insulating housing 2280. Gasket or O-ring 2282 can be placed in recess 2284 in a front of insulating housing 2280 to seal insulating housing 2270 to insulating housing 2280. Drip holes 2224 can provide a path to expel moisture when a corresponding plug connector, such as plug connector 2100 (shown in FIG. 17), is inserted into connector receptacle 2200. More specifically, as plug connector 2100 is inserted, cross-members 2246, or other deflecting members, can deflect and push moisture out drip holes 2224. Moisture can also be pushed into well 2234, which can be bounded by gasket or O-ring 2272, face spring 2260, and a front portion 2232 of back enclosure 2230. An example of such a mated connection is shown in the following figure.

Figure 25:
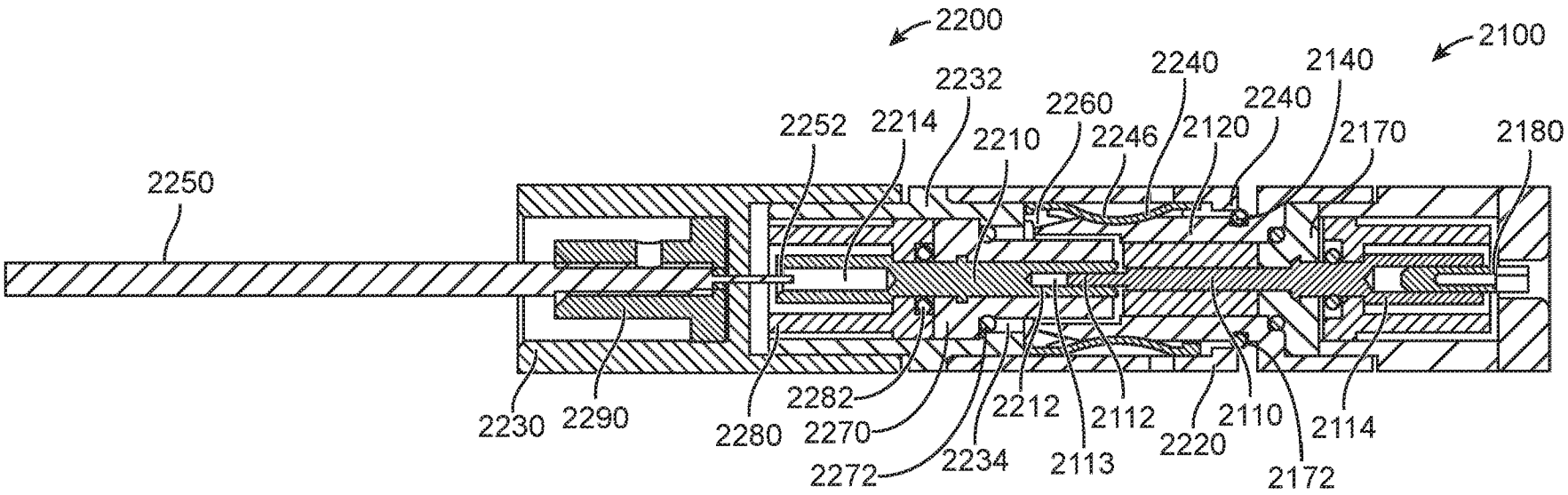
FIG. 25 illustrates a cross-section of a connector system according to an embodiment of the present invention.

FIG. 25 illustrates a cross-section of a connector system according to an embodiment of the present invention. In this example, plug connector 2100 has been inserted into connector receptacle 2200. A conductor 2252 of cable 2250 can be attached to connecting portion 2214 of tulip pin 2210 in connector receptacle 2200. A braiding or ground shield (not shown) of cable 2250 can be attached to cable crimp 2290. Contact portion 2212 of tulip pin 2210 can accept pin tip 2112 of signal pin 2110 in plug connector 2100. Connecting portion 2114 of signal pin 2110 can accept connection 2180 to complete a signal path through this connector system.

Cross-member 2246 of perimeter spring 2240 can physically and electrically contact sides of plug enclosure 2120. Face spring 2260 can physically and electrically contact a front tip or front edge of plug enclosure 2120. These physical and electrical contacts can form an electrical connection between plug enclosure 2120, the front portion 2232 of back enclosure 2230, and enclosure 2220. This electrical connection can provide a short ground path between plug connector 2100 and connector receptacle 2200. The short ground path can help to prevent loop currents that might otherwise form in plug enclosure 2120, front portion 2232 of back enclosure 2230, and enclosure 2220.

When plug connector 2100 is inserted into connector receptacle 2200, plug enclosure 2120 can deflect cross-members 2246 of perimeter spring 2240, deforming cross-members 2246 towards an inside surface of enclosure 2220. This deflection or deformation can help to expel fluids or other debris that can be located in front opening 2222 (shown in FIG. 21) of connector receptacle 2200 out of connector receptacle through drip holes 2224 (shown in FIG. 20). Remaining moisture and debris can be pushed into well 2234 between insulating housing 2270 and front portion 2232 of back enclosure 2230. Gasket or O-ring 2272 can help to prevent moisture in well 2234 from being pushed further back into connector receptacle 2200. Moisture in connector receptacle 2200 can also be pushed into space 2113 by pin tip 2112 during its insertion into contact portion 2212 of tulip pin 2210.

Multiple features can help to retain plug connector 2100 in connector receptacle 2200 when plug connector 2100 is inserted into connector receptacle 2200. For example, cross-members 2246 of perimeter spring 2240 in connector receptacle 2200 can exert a holding force on plug enclosure 2120 of plug connector 2100. Also, contact portion 2212 of tulip pin 2210 in connector receptacle 2200 can hold pin tip 2112 of signal pin 2110 in plug connector 2100. Contact portion 2212 can have a reduced number of beams, such as three, four, or more than four beams. These beams can also be arranged to have a longer length and increased thickness to provide an increase in their durability and retention force.

In this example, several gaskets can be used to protect plug connector 2100 and connector receptacle 2200. Gasket or O-ring 2140 can help to seal plug enclosure 2120 to enclosure 2220 of connector receptacle 2200 to prevent moisture leakage while a connection is formed. Gasket or O-ring 2172 can seal a moisture path between enclosure portion 2160 and plug enclosure 2120 in plug connector 2100. Gasket or O-ring 2272 can seal a moisture path between insulating housing 2170 and front portion 2232 of back enclosure 2230. Gasket or O-ring 2282 can seal moisture paths between insulating housing 2270 and insulating housing 2280, and between insulating housing 2280 and tulip pin 2210. Each of these gaskets or O-rings, and the gaskets or O-rings shown herein, can be formed of rubber, silicon rubber, or other elastomeric or pliable material.

These embodiments of the present invention can provide improved grounding. A braiding or shield (not shown) can be soldered to cable crimp 2290. Cable crimp 2290 can be attached by soldering, or spot or laser welding to back enclosure 2230. Front portion 2232 of back enclosure 2230 can be attached by soldering, or spot or laser welding to back enclosure 2230 and enclosure 2220. Face spring 2260 and perimeter spring 2240 can physically and electrically connect to enclosure 2220 of connector receptacle 2200 and plug enclosure 2120 of plug connector 2100. Plug enclosure 2120 can be attached by soldering, or spot or laser welding to enclosure back body 2130. A front edge or front tip of plug enclosure 2120 can engage face spring 2260, which can contact enclosure 2220. Sides of plug enclosure 2120 can engage deflecting cross-members 2246 of perimeter spring 2240, which can contact enclosure 2220 through front band 2242 and back band 2244.

In various embodiments of the present invention, a plug connector, such as plug connector 2100, can be formed to attach to a printed circuit board or other appropriate substrate. An example is shown in the following figures.

Figure 26:
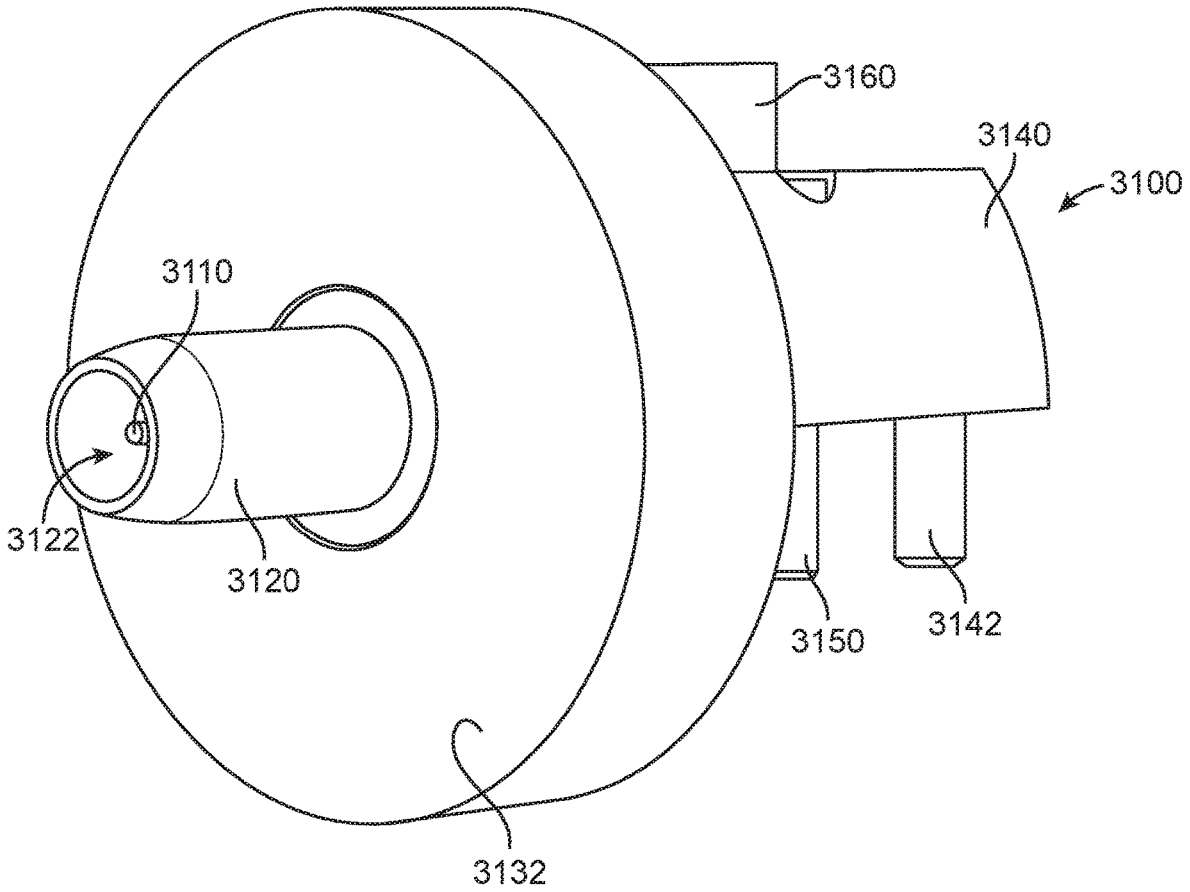
FIG. 26 illustrates a plug connector according to an embodiment of the present invention that can be mounted on a printed circuit board or other appropriate substrate.

FIG. 26 illustrates a plug connector according to an embodiment of the present invention that can be mounted on a printed circuit board or other appropriate substrate. Similar to the above example in FIG. 17, plug connector 3100 can include plug enclosure 3120 having opening 3122 to provide access to signal pin 3110. Magnetic target 3132 can attract a magnet in a corresponding connector. Housing 3140 can be positioned to rest or lie flat on a printed circuit board or other appropriate substrate (not shown.) Pins or posts 3142 can be inserted into plated through-holes in the printed circuit board or other appropriate substrate for grounding purposes. Pins or posts 3142 can be formed with housing 3140 as posts, or added as pins to housing 3140. Pins 3150 can also be inserted into second openings in the printed circuit board or other appropriate substrate. The second openings can be plated or non-plated through-holes. Cap 3160 can be threaded into opening 3146 (shown in FIG. 29) in a top of housing 3140.

Figure 27:
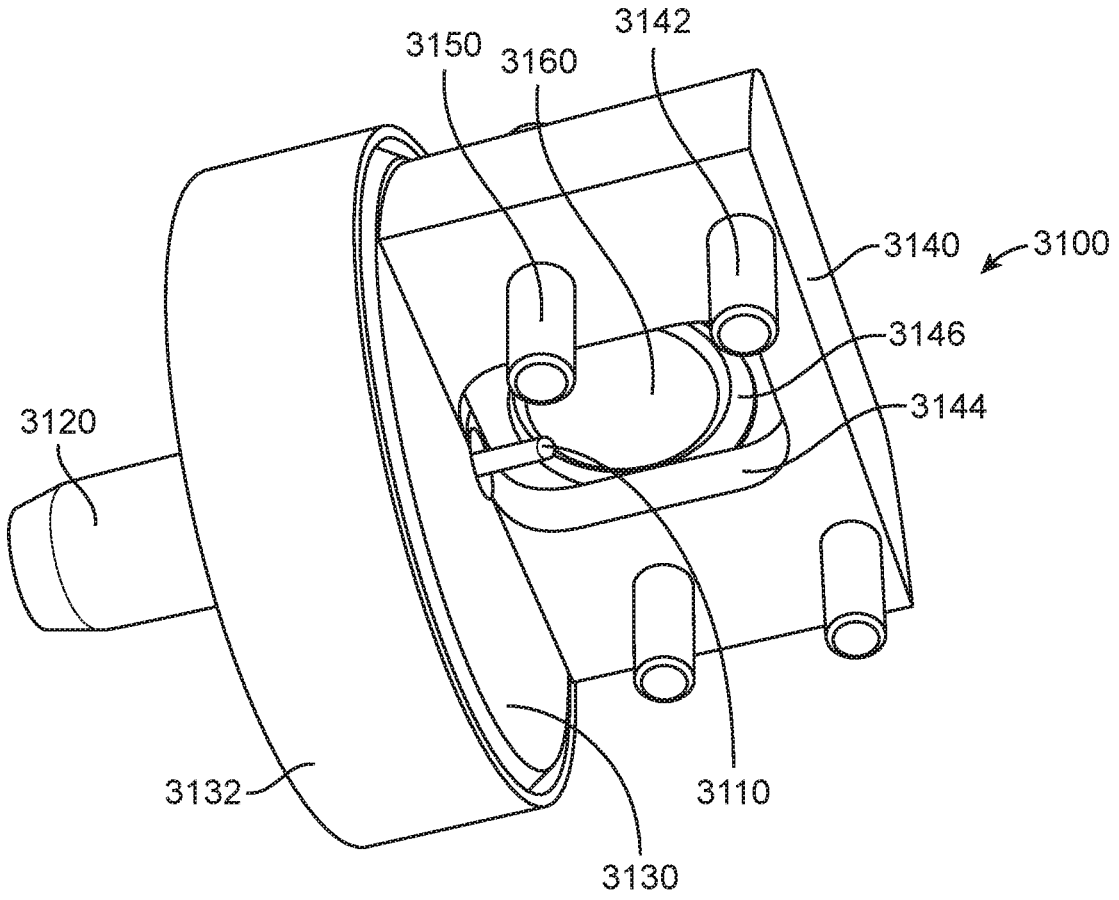
FIG. 27 illustrates an underside of a plug connector according to an embodiment of the present invention.

FIG. 27 illustrates an underside of a plug connector according to an embodiment of the present invention. Plug enclosure 3120 can shield a signal pin 3110. Magnetic target 3132 can cover housing portion 3130. Housing portion 3130 can be formed with housing 3140 to form a body for plug connector 3100, or housing portion 3130 can be formed separately from housing 3140. Magnetic target 3132 can be a portion of a device enclosure for an electronic device. Signal pin 3110 can be located in opening 3144 in housing 3140. Pins or posts 3142 can extend from a bottom side of housing 3140 to be inserted into plated through-holes in a printed circuit board or other appropriate substrate (not shown), where the plated through-holes can be grounded. Pins 3150 can also extend from a bottom side of housing 3140 to be inserted into holes in the printed circuit board or other appropriate substrate. These holes can remain non-plated to improve alignment.

More specifically, during assembly, it can be very important that signal pin 3110 be directly aligned with a trace (not shown) on the printed circuit board or other appropriate substrate. Misalignments between signal pin 3110 and this trace can cause spurious emissions, insertion loss, and reflections. To improve the alignment of signal pin 3110 to this printed circuit board trace, pins 3150 can be press-fit through housing 3140 and into through-holes in the printed circuit board or other appropriate substrate. The openings for pins 3150 in the printed circuit board or other appropriate substrate can be left non-plated to improve the accuracy of this alignment. To inspect the resulting alignment, cap 3160 can be removed from opening 3146 or left uninstalled until after inspection. The absence of cap 3160 can allow inspection of the alignment between signal pin 3110 and its corresponding trace through opening 3146 in housing 3140. That is, opening 3146 and opening 3144 can form a visual passage through which inspection of a connection to signal pin 3110 can be made. After inspection, this connection can be reworked as necessary. When complete, cap 3160 can be threaded into opening 3146 to complete a shield around signal pin 3110. An example of plug connector 3100 without cap 3160 is shown in the following figure.

Figure 28:
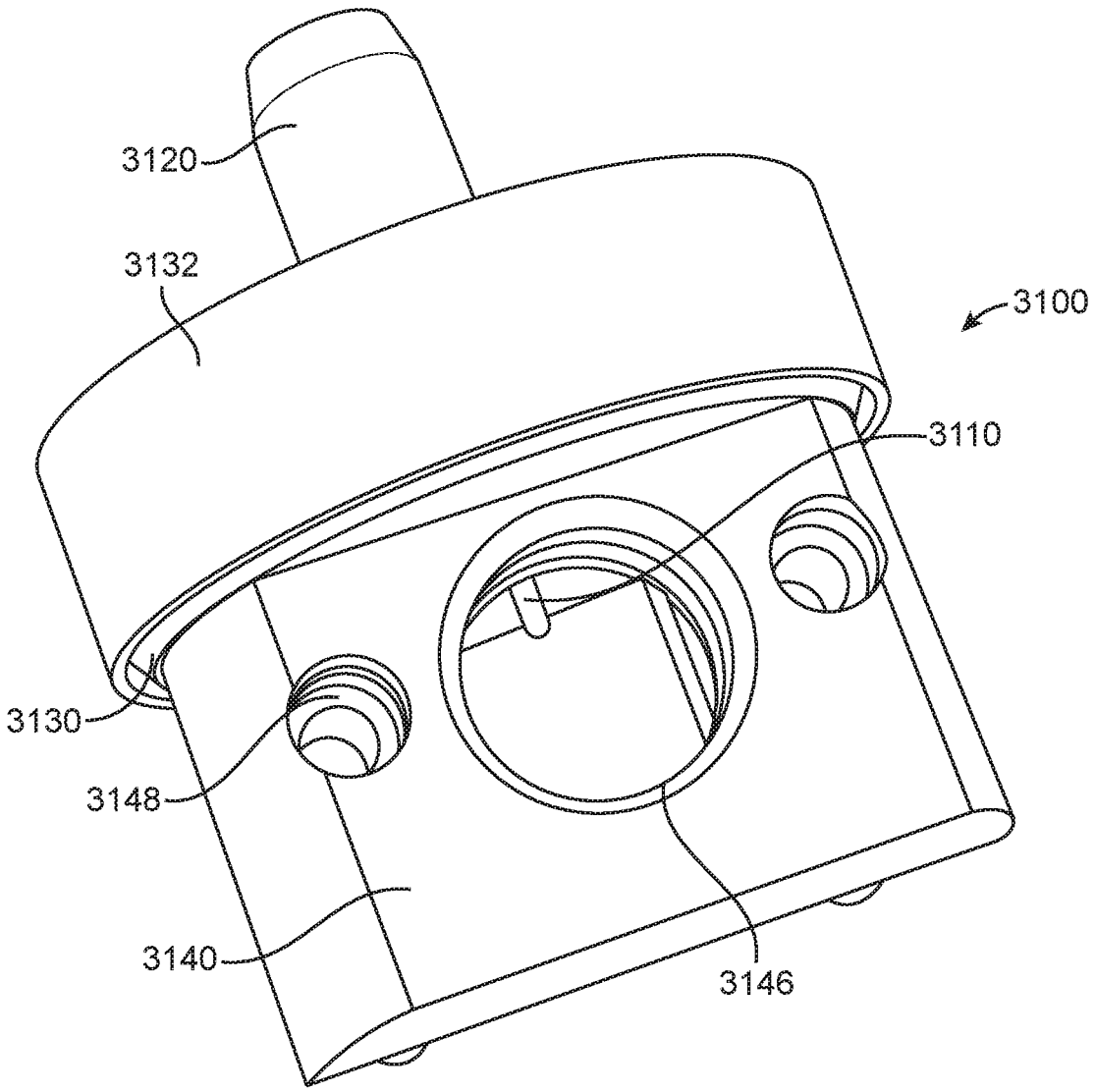
FIG. 28 illustrates a plug connector according to an embodiment of the present invention.

FIG. 28 illustrates a plug connector according to an embodiment of the present invention. In this example, cap 3160 and pins 3150 (shown in FIG. 27) have been removed or have yet to be installed. Plug enclosure 3120 can shield signal pin 3110. Magnetic target 3132 can be positioned over housing portion 3130. Opening 3146 and opening 3144 (shown in FIG. 27) in housing 3140 can provide for a visual inspection of alignment between signal pin 3110 and a corresponding trace (not shown) on a printed circuit board or other appropriate substrate (not shown.) Openings 3148 can provide passages for pins 3150. Pins 3150 can be press-fit into openings 3148 and into through-holes in the printed circuit board or other appropriate substrate. These through-holes can be non-plated through-holes to improve alignment between pins 3150 and the printed circuit board or other appropriate substrate, thereby improving alignment between signal pin 3110 of plug connector 3100 and its corresponding trace on the printed circuit board.

Figure 29:
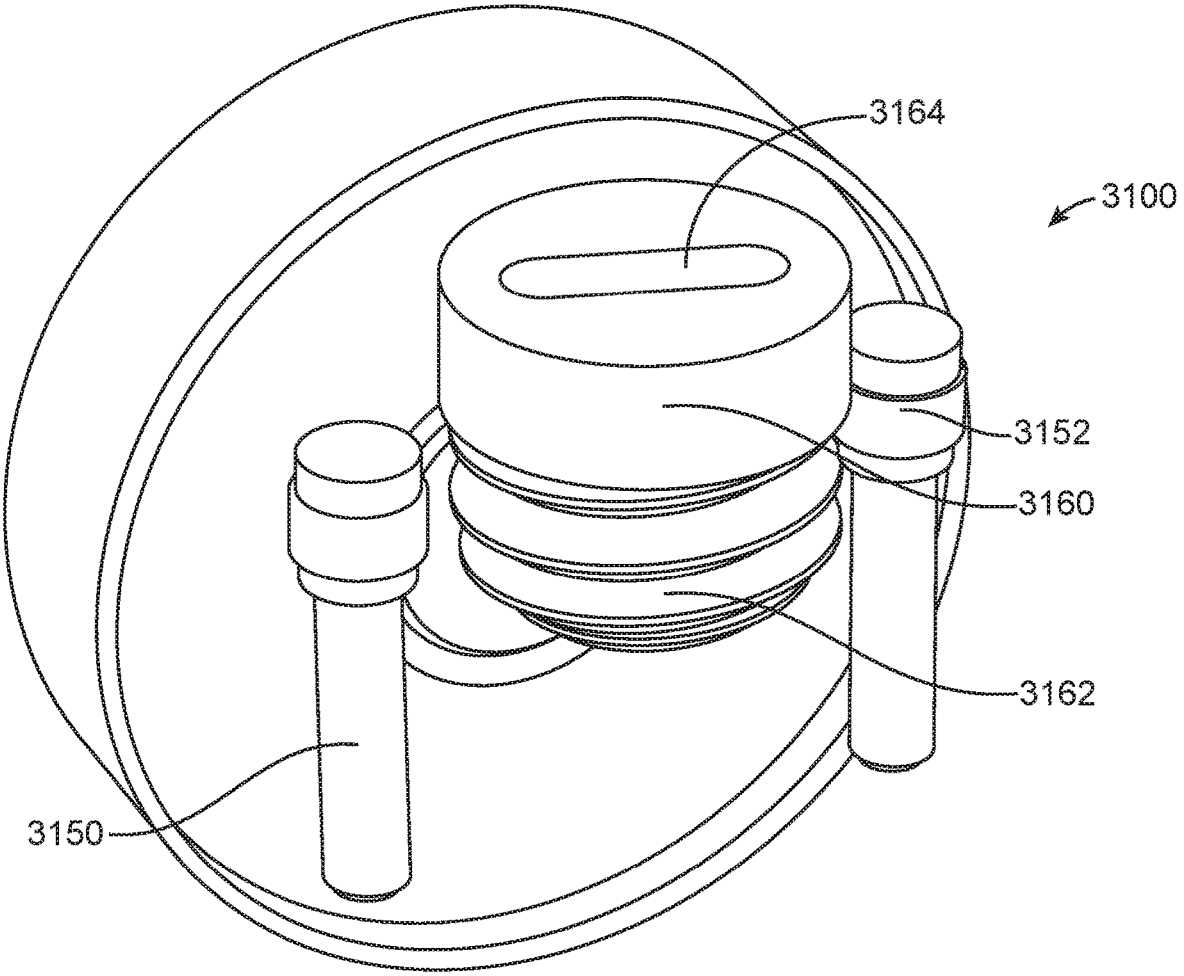
FIG. 29 illustrates portions of a plug connector according to an embodiment of the present invention.
Figure 30:
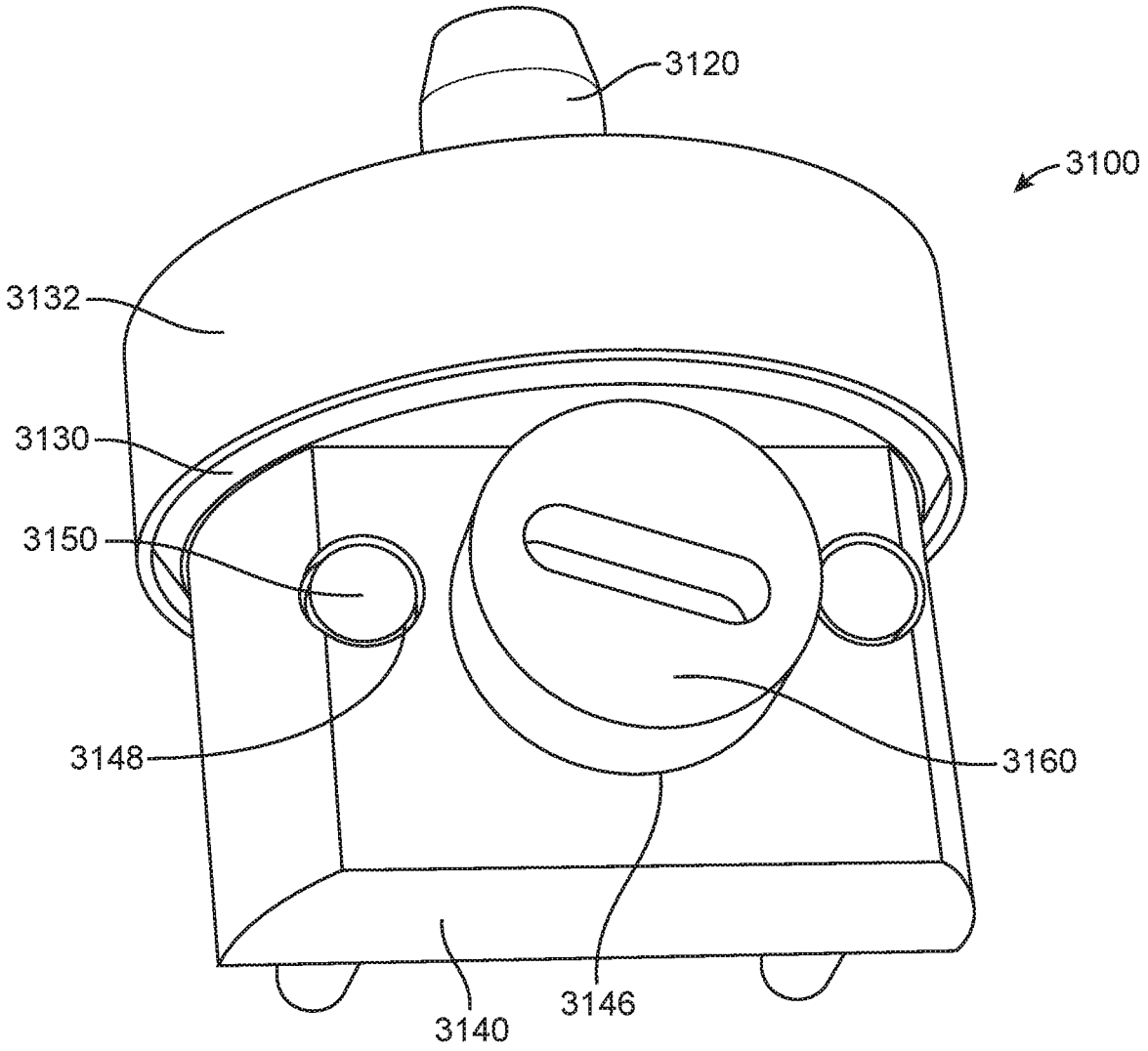
FIG. 30 illustrates a top view of a plug connector according to an embodiment of the present invention.

FIG. 29 illustrates portions of a plug connector according to an embodiment of the present invention. In this example, cap 3160 can include slot 3164. Slot 3164 can be arranged to accept an edge of a screwdriver or other tool. Cap 3160 can further include threaded portion. Using a tool such as a screwdriver, threaded portion 3162 of cap 3160 can be threaded into opening 3146 in housing 3140 (as shown in FIG. 30.) Pins 3150 can include head 3152 that can fit in opening 3146 in housing 3140 (as shown in FIG. 30) of plug connector 3100.

FIG. 30 illustrates a top view of a plug connector according to an embodiment of the present invention. Plug enclosure 3120 can shield signal pin 3110 (shown in FIG. 29) that can convey a signal from corresponding connector receptacle 2200 (shown in FIG. 20) to a board or other appropriate substrate (not shown) on which housing 3140 can be placed.

Magnetic target 3132 can be located behind plug enclosure 3120. Cap 3160 can be threaded into opening 3146 in housing 3140 to complete a shield around the signal pin. Pins 3150 can be press-fit into openings 3148 in housing 3140.

Cap 3160 can be threaded into housing 3140 after an inspection of the alignment between signal pin 3110 and a trace (not shown) on a printed circuit board or other appropriate substrate. Threading cap 3160 into opening 3146 in housing 3140 can exert a reduced force on the connection between signal pin 3110 and the trace as compared to press-fitting a different cap or using another manufacturing technique. This reduced force can help to prevent damage to this connection, which could degrade the alignment between signal pin 3110 and its corresponding trace. Threading cap 3160 into opening 3146 also allows for additional inspections and reworking of the connection between signal pin 3110 and its trace as necessary.

Once cap 3160 is threaded into opening 3146, housing 3140 and housing portion 3130 can form shielding in front of and over signal pin 3110. Additional shielding can be included on the printed circuit board or other appropriate substrate. For example, an underside of the printed circuit board can be plated with a ground plane. This ground plane can be connected to the plated through-holes for pin or posts 3142 (shown in FIG. 27.) Ground planes or ground traces can also be located on a top surface of the printed circuit board on one or more sides the trace connected to signal pin 3110.

Plug enclosure 3120 and magnetic target 3132 can be formed of conductive metal such as stainless steel, or other appropriate material. Magnetic target 3132 can be formed of ferrous stainless steel or other ferrous material. Signal pin 3110 can be formed of copper, bronze, or other conductive material. Signal pin 3110 can be plated with gold or other material to improve corrosion performance and reduce resistance. Plug connector 3100 can include insulating housings similar to insulating housing 2150 and insulating housing 2170. These insulating housings can be formed of plastic, nylon, or other non-conductive material. Housing 3140, cap 3160, and housing portion 3130 can be formed of steel, brass, bronze, copper, or other material. These can be plated, for example with nickel to reduce induced currents. In these and other embodiments of the present invention, one or more magnets can also be included. For example, some or all of either or both housing portion 3130 and magnetic target 3132 can be formed of one or more magnets.

Figure 31:
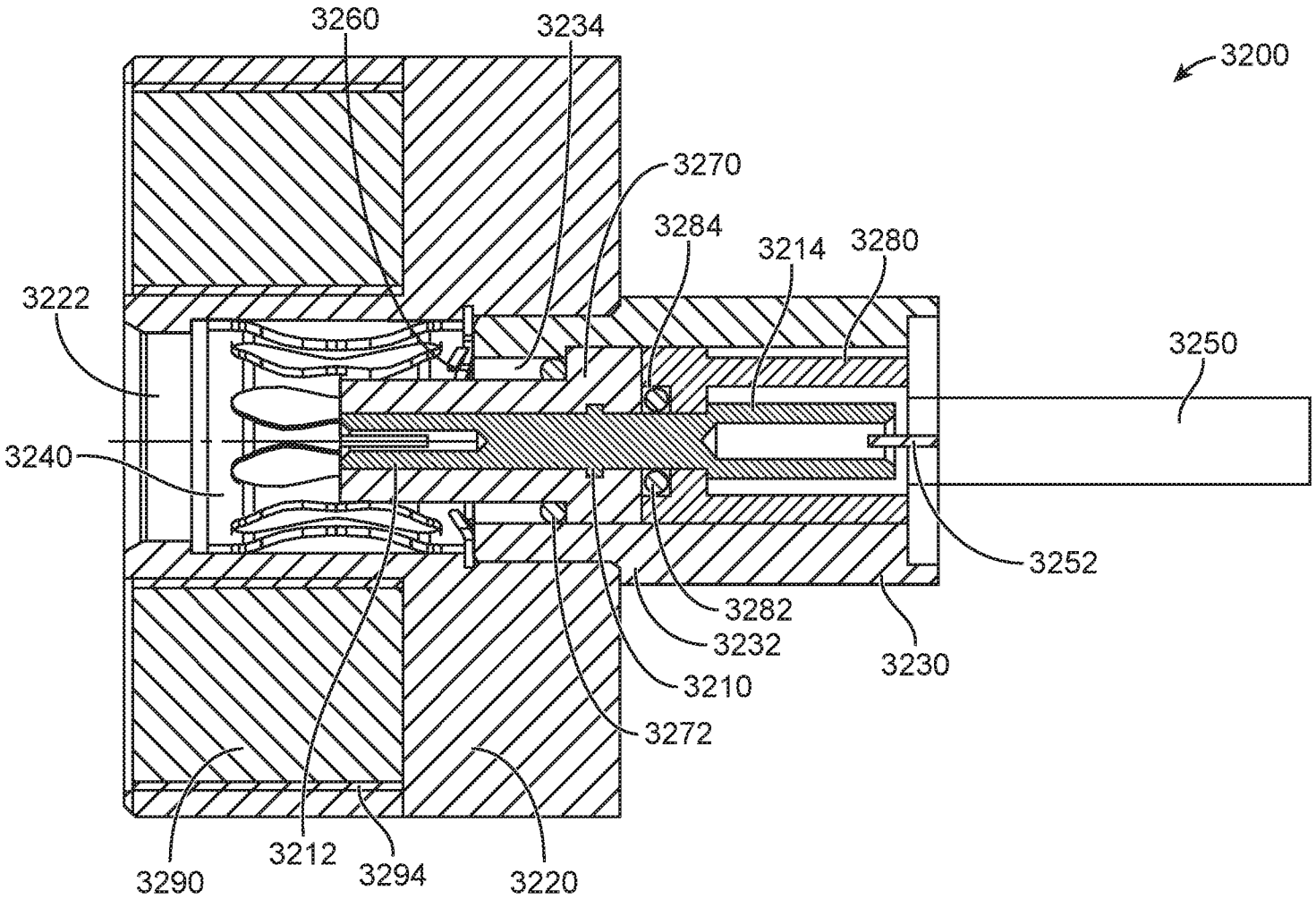
FIG. 31 illustrates a cross-section of a connector receptacle according to an embodiment of the present invention.

FIG. 31 illustrates a cross-section of a connector receptacle according to an embodiment of the present invention. Enclosure 3220 can include front opening 3222 to provide access to perimeter spring 3240, face spring 3260, and contact portion 3212 of tulip pin 3210. Tulip pin 3210 can further include connecting portion 3214 for accepting a conductor 3252 of cable 3250. Front portion 3232 of back enclosure 3230 can be fit in a rear of enclosure 3220. Tulip pin 3210 can be isolated from enclosure 3220 and back enclosure 3230 by insulating housing 3270 and insulating housing 3280. Gasket or O-ring 3282 can be placed in recess 3284 in a front of insulating housing 3280 to seal insulating housing 3270 to insulating housing 3280. Moisture can be pushed into well 3234, which can be bounded by gasket or O-ring 3272, face spring 3260, and a front portion 3232 of back enclosure 3230. Magnet 3290 can be formed of one or more magnets, where the one or more magnets can be arranged to have the same or opposite polarities. Magnet 3290 can be positioned circumferentially around at least a portion of tulip pin 3210. Magnet 3290 can be formed of one or more magnets placed on a top and bottom, or sides, or circumferentially around or near a portion of tulip pin 3210. Magnet 3290 can be attracted to magnetic target 3132 (shown in FIG. 26) when connector receptacle 3200 is mated with plug connector 3100. Magnet 3290 can be protected from enclosure 3220 by protective layer 3294.

Various structures in connector receptacle 3200 can be the same or similar to structures in connector receptacle 2200 above. For example, enclosure 3220, perimeter spring 3240, face spring 3260, tulip pin 3210, back enclosure 3230, gasket or O-ring 3272, gasket or O-ring 3282, insulating housing 3270, and insulating housing 3280 can be the same or similar to their corresponding structures in connector receptacle 2200, namely enclosure 2220, perimeter spring 2240, face spring 2260, tulip pin 2210, back enclosure 2230, gasket or O-ring 2272, gasket or O-ring 2282, insulating housing 2270, and insulating housing 2280, respectively. Connector receptacle 3200 can mate with plug connector 3100 in the same or similar manner as connector receptacle 2200 mates with plug connector 2100. Connector receptacle 3200 can mate with plug connector 2100 in the same or similar manner as connector receptacle 2200 mates with plug connector 2100. Connector receptacle 2200 can mate with plug connector 3100 in the same or similar manner as connector receptacle 2200 mates with plug connector 2100.

Various structures can be used as the connector portion 300 and other coaxial or other connector portions that can be included in connectors inserts according to embodiments of the present invention. These coaxial connectors and coaxial or other connector portions can be purchased from a vendor or their construction can be included as part of the construction of connectors inserts according to embodiments of the present invention. For example, these coaxial connectors or coaxial or other connector portions can be manufactured for example, by Corning Gilbert of Glendale, Ariz., a wholly owned subsidiary of Corning Incorporated, of Corning N.Y., as one of their GPPO Cable Connectors, or by Carlisle Interconnect Technologies of Cerritos, Calif., as one of their SSMP connectors.

In various embodiments of the present invention, pins, ground contacts, and other conductive portions of a connector receptacle or connector insert can be formed by stamping, metal-injection molding, machining, micro-machining, 3-D printing, or other manufacturing process. The conductive portions can be formed of stainless steel, steel, copper, copper titanium, phosphor bronze, or other material or combination of materials. They can be plated or coated with nickel, gold, or other material. The nonconductive portions, such as the housings, insulators, or other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials. The boards used can be formed of FR-4 or other material. The boards can be printed circuit boards or other substrates, such as flexible circuit boards, in many embodiments of the present invention. The magnets can be rare-earth or other types of magnets. The ferromagnetic materials can be ferrimagnetic or other type of magnetically conductive material.

Embodiments of the present invention can provide connector receptacles and connector inserts that can be located in, and can connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, test systems, adapters, remote control devices, chargers, and other devices. In various embodiments of the present invention, interconnect paths provided by these connector inserts and connector receptacles can be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A plug connector for a magnetic connector system, the plug connector comprising:

a signal pin;

a housing having a visual passage extending from a top of the housing to the signal pin, wherein a portion of an inside surface of the visual passage is threaded;

a magnetic target attached to the housing, the magnetic target positioned to attract a magnet in a corresponding connector receptacle and to hold the corresponding connector receptacle in place relative to the plug connector when the plug connector is mated with the corresponding connector receptacle;

a plug enclosure around a portion of the signal pin, the signal pin extending into the visual passage in the housing; and a cap having a threaded portion to mate with the threaded inside surface of the visual passage.

2. The plug connector of claim 1 wherein the housing further comprises a plurality of posts arranged to fit in openings in a printed circuit board.

3. The plug connector of claim 2 further comprising a plurality of pins extending through the housing.

4. The plug connector of claim 3 wherein the pins are arranged to fit in openings in the printed circuit board.

5. The plug connector of claim 4 further comprising an insulating housing between the signal pin and the plug enclosure.

6. The plug connector of claim 5 wherein the magnetic target is formed of ferrous stainless steel.

7. The plug connector of claim 6 wherein the housing is formed of brass.

8. The plug connector of claim 7 wherein the housing is nickel plated.

9. A connector receptacle for a connector system, the connector receptacle comprising:

an enclosure having a front opening to accept a corresponding plug connector when the corresponding plug connector is inserted into the connector receptacle;

a signal pin having a pin tip exposed in the front opening; and a perimeter spring comprising a plurality of deflecting members, a front band, and a back band, the plurality of deflecting members in the front opening positioned radially around the signal pin, wherein the each of the plurality of deflecting members attach to the front band at a first end and the back band at a distal second end, wherein the front band and back band each comprise a break, and wherein the plurality of deflecting members deflect towards an inside surface of the enclosure when the corresponding plug connector inserted into the connector receptacle, wherein the enclosure further comprises a plurality of side openings through a side of the enclosure.

10. The connector receptacle of claim 9 wherein the deflecting members and enclosure side openings are arranged such that moisture in the front opening is expelled when the corresponding plug connector inserted into the connector receptacle.

11. The connector receptacle of claim 10 further comprising an insulating housing between the signal pin and the enclosure.

12. The connector receptacle of claim 11 further comprising a gasket between the signal pin and the enclosure.

13. The connector receptacle of claim 12 further comprising a magnet around the front opening.

14. The connector receptacle of claim 13 wherein the magnet is arranged to be attracted to a magnetic target in the corresponding plug connector.

15. The plug connector of claim 1 wherein the magnetic target has an annular shape and is positioned around the signal pin.

16. The connector receptacle of claim 9 wherein the break in the front band and the break in the back band allow for expansion of the perimeter spring during insertion of a corresponding plug connector into the connector receptacle.

17. The connector receptacle of claim 9 further comprising a face spring, the face spring comprising a plurality of teeth extending from a ring, wherein each of the teeth are clocked relative to an inside surface of the ring and angled away from a plane defined by the ring and towards the perimeter spring.

18. A connector receptacle for a connector system, the connector receptacle comprising:

an enclosure having a front opening to accept a corresponding plug connector when the corresponding plug connector is inserted into the connector receptacle;

one or more magnets positioned around the front opening in the enclosure;

a signal pin having a pin tip exposed in the front opening; and a perimeter spring comprising a plurality of deflecting members, a front band, and a back band, the plurality of deflecting members in the front opening positioned radially around the signal pin, wherein the each of the plurality of deflecting members attach to the front band at a first end and the back band at a distal second end, wherein the front band and back band each comprise a break, and wherein the plurality of deflecting members deflect towards an inside surface of the enclosure when the corresponding plug connector inserted into the connector receptacle.

19. The connector receptacle of claim 18 wherein the one or more magnets are arranged to be attracted to a magnetic target in the corresponding plug connector.

20. The connector receptacle of claim 18 further comprising a face spring, the face spring comprising a plurality of teeth extending from a ring, wherein each of the teeth are clocked relative to an inside surface of the ring and angled away from a plane defined by the ring and towards the perimeter spring.

* * * * *